US009642755B2

(12) United States Patent
Nishiyama et al.

(10) Patent No.: US 9,642,755 B2
(45) Date of Patent: May 9, 2017

(54) MOUNTING DEVICE FOR OBJECT TO BE MOUNTED

(71) Applicant: HONDA MOTOR CO., LTD., Tokyo (JP)

(72) Inventors: Kimito Nishiyama, Saitama (JP); Daisuke Watanabe, Saitama (JP); Satoru Nishimoto, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/650,684

(22) PCT Filed: Dec. 11, 2013

(86) PCT No.: PCT/JP2013/083218
§ 371 (c)(1),
(2) Date: Jun. 9, 2015

(87) PCT Pub. No.: WO2014/092119
PCT Pub. Date: Jun. 19, 2014

(65) Prior Publication Data

US 2015/0305952 A1 Oct. 29, 2015

(30) Foreign Application Priority Data

Dec. 11, 2012 (JP) ..... 2012-270478

(51) Int. Cl.
*A61G 3/06* (2006.01)
*A61G 3/08* (2006.01)

(52) U.S. Cl.
CPC ..... *A61G 3/061* (2013.01); *A61G 3/062* (2013.01); *A61G 3/0808* (2013.01)

(58) Field of Classification Search
CPC .... B60P 1/43; B60P 1/48; B60P 1/438; B60P 1/436; B60P 1/435; B60P 1/433;
(Continued)

(56) References Cited

U.S. PATENT DOCUMENTS 1,569,469 A 1/1926 Elzey
3,030,645 A 4/1962 Shaw
(Continued)

FOREIGN PATENT DOCUMENTS

CA 2 174 382 10/1997
CN 201058082 Y 5/2008
(Continued)

OTHER PUBLICATIONS

Japanese Office Action dated Jan. 26, 2016, 4 pages.
(Continued)

*Primary Examiner* — Kaitlin Joerger
(74) *Attorney, Agent, or Firm* — Rankin, Hill & Clark LLP

(57) ABSTRACT

A mounting device includes: a main plate on which a wheelchair is to be mounted; a vehicle side plate provided between one end of the main plate and a vehicle body; a ground side plate provided between another end of the main plate and a ground surface; and first to third rotating shafts provided between the vehicle body and the vehicle side plate, and between each of the plates. A slope is configured to include the main plate, the vehicle side plate, the ground side plate and the first to third rotating shafts. The slope is provided so that the main plate is displaced between a low position and a high position by rotating the first to third rotating shafts using a drive mechanism.

14 Claims, 16 Drawing Sheets

(58) Field of Classification Search
CPC .. B60P 1/44; B60P 1/4407; B60P 3/00; B60P 3/122; B60P 3/41; B60N 99/00; B65G 69/28; B62B 5/0003
USPC ..... 414/538
See application file for complete search history.

(56) References Cited

U.S. PATENT DOCUMENTS

| | | | | |
|---|---|---|---|---|
| 3,679,074 | A * | 7/1972 | Kuehl | B60P 1/44 296/57.1 |
| 5,312,148 | A * | 5/1994 | Morgan | B60P 1/435 296/61 |
| 5,791,717 | A * | 8/1998 | Reich | B60P 1/435 14/71.1 |
| 6,149,372 | A * | 11/2000 | Lee | B62B 5/0003 414/500 |
| 6,616,396 | B2 * | 9/2003 | Sternberg | B60P 1/431 414/538 |
| 7,001,132 | B2 * | 2/2006 | Koretsky | A61G 3/061 414/537 |
| 7,533,432 | B2 * | 5/2009 | Morris | A61G 3/061 14/71.3 |
| 7,637,518 | B2 * | 12/2009 | Adair | B65G 69/30 280/163 |
| 8,122,551 | B2 * | 2/2012 | Istre | B60P 1/43 14/69.5 |
| 8,197,176 | B2 * | 6/2012 | Salazar Corcuera | B60P 1/435 414/500 |
| 8,302,235 | B1 * | 11/2012 | Bailie | B60P 1/43 14/69.5 |
| 8,821,102 | B1 * | 9/2014 | Boguslawski | B65G 69/30 14/71.1 |
| 9,011,073 | B2 * | 4/2015 | Dieziger | B60P 1/433 414/506 |
| 9,271,883 | B2 * | 3/2016 | Johnson | A61G 3/061 |
| 2003/0223847 | A1 * | 12/2003 | Crider | B60P 1/4407 414/438 |
| 2007/0246965 | A1 | 10/2007 | Adair | |
| 2008/0246295 | A1 * | 10/2008 | Bejin | B60P 1/003 296/61 |
| 2009/0269176 | A1 | 10/2009 | Smith et al. | |
| 2011/0088177 | A1 | 4/2011 | Johnson et al. | |
| 2012/0204360 | A1 * | 8/2012 | Chamoun | B62D 63/061 14/2.4 |
| 2015/0086313 | A1 * | 3/2015 | Perez | B60P 1/431 414/537 |
| 2015/0224907 | A1 * | 8/2015 | Holmgren | B60P 3/08 414/482 |
| 2015/0305952 | A1 | 10/2015 | Nishiyama et al. | |

FOREIGN PATENT DOCUMENTS

| | | | |
|---|---|---|---|
| CN | 102038585 | A | 5/2011 |
| CN | 102256830 | A | 11/2011 |
| EP | 2016925 | A1 | 1/2009 |
| EP | 2933147 | A1 | 10/2015 |
| GB | 2 170 174 | A | 7/1986 |
| JP | 57-186541 | | 11/1982 |
| JP | S-115394 | | 4/1994 |
| JP | 2001-276135 | | 10/2001 |
| JP | 2002-154368 | | 5/2002 |
| JP | 2004-196027 | | 7/2004 |
| JP | 2006-271661 | | 10/2006 |
| JP | 2010-143302 | | 7/2010 |
| WO | 02/079018 | | 10/2002 |

OTHER PUBLICATIONS

Extended European Search Report dated Aug. 26, 2016, Application No. EP 13 86 2613.
Chinese Office Action dated May 5, 2016, 5 pages.
Canadian Office Action dated Jun. 6, 2016, 3 pages.
Chinese Office Action dated Jan. 19, 2017.

* cited by examiner

UP
DOWN
FRONT
REAR
10c
18
20
22
34
36
38
40a
40b
40c
90
92
94
96

UP
DOWN
FRONT
REAR
10c
18
20
22
34
36
38
40a
40b
40c
90
92a
94
96

MOUNTING DEVICE FOR OBJECT TO BE MOUNTED

TECHNICAL FIELD

The present invention relates to a mounting device for mounting on a vehicle an object to be mounted, for example, a wheelchair in which a cared person sits.

BACKGROUND ART

For example, Patent Literature 1 discloses a wheelchair lifting device for lifting a wheelchair along a slope which is bridged between a road surface and a floor surface of a vehicle body rear opening. The wheelchair lifting device employs a structure for lifting the wheelchair along the slope while a passenger sits in the wheelchair by winding a belt which is engaged with the wheelchair by an electric winch.

Also, Patent Literature 2 discloses a lifter for a vehicle for mounting a wheelchair on the vehicle, which is moved up and down between the ground surface and a floor surface at a vehicle body rear opening.

CITATION LIST

Patent Literature

Patent Literature 1: Japanese Patent Application Publication No. 2006-271661

Patent Literature 2: Japanese Published Examined Application No. S63-49653

SUMMARY OF THE INVENTION

Technical Problem

Meanwhile, in recent years, vehicles (for example, a hybrid vehicle, an electric vehicle, or the like) have been increased in which a battery is mounted under the vehicle floor to allow a ground clearance of the opening bottom (hereinafter referred to as an opening ground clearance) of a tailgate at a rear portion of the vehicle body to be higher than in the conventional art. In a case where the wheelchair lifting device disclosed in Patent Literature 1 is applied to such a vehicle having a high opening ground clearance, an inclination angle and a front-rear length of the slope are affected when the slope is grounded, and an excessive load is applied to the electric winch for winding the belt. When a motor for the electric winch is increased in size in order to reduce the load for the electric winch, the electric winch per se is increased in size to narrow a vehicle compartment space and to increase a vehicle weight.

Also, the lifter for a vehicle disclosed in Patent Literature 2 poses problems in that a vehicle weight increases and a cost rises, because the lifter per se is constituted by a lot of components.

Moreover, for example, when the slope bridged between the road surface and the floor surface of the vehicle body rear opening is provided to move a part thereof up and down, the slope needs to avoid interfering with the rear portion of the vehicle body.

A general object of the present invention is to provide a mounting device for an object to be mounted, which is lightweight and inexpensive, and can also be applied to a vehicle having a high opening ground clearance.

Another object of the present invention is to provide a mounting device for an object to be mounted, which can avoid interference of a slope with a rear portion of a vehicle body.

Solution to Problem

In order to attain the above objects, the present invention provides amounting device for an object to be mounted, including: a main plate on which the object to be mounted is to be mounted; a vehicle side plate which is provided between one end of the main plate and a vehicle body, and is composed of at least one plate; a ground side plate which is provided between another end of the main plate and a ground surface, and is composed of at least one plate; a plurality of rotating shafts which are provided between the vehicle body and the vehicle side plate, and between each of the plates; and a drive means that rotates the rotating shafts, wherein a slope is configured to include the main plate, the vehicle side plate, the ground side plate, and the plurality of rotating shafts, and the slope is provided to allow the main plate to be displaced between a low position and a high position by rotating the plurality of rotating shafts with the drive means.

According to the present invention, the main plate constituting the slope can be stably displaced (changed in position) between the low position and the high position, without moving the other end of the ground side plate which is grounded to the ground surface. Therefore, it is possible to suitably prevent a load from being applied to the main plate at the time of displacement of the main plate, without generating a frictional force between the other end of the ground side plate and the ground surface.

Also, even when the slope in the present invention is provided on a vehicle having a high opening ground clearance, the object to be mounted (e.g., a wheelchair) can be got in and got out of the vehicle with a low load, without increasing an inclination angle of the slope or increasing a front-rear length of the slope.

Moreover, since the front-rear length of the slope need not be increased, an expansion space of the slope can be reduced, thereby improving the convenience.

Consequently, in the present invention, the slope can be made lightweight and inexpensive by making itself a simple structure, and the slope can also be suitably applied to a vehicle having a high opening ground clearance by stably displacing (changing the position of) the main plate on which the object to be mounted is mounted, between the low position and the high position.

In addition, where electric winches are attached to the present invention, since the object to be mounted can be got in the vehicle with a lower load, a lifting force for the object to be mounted by the electric winches can be reduced to avoid an increase in size of the electric winches. Also, in the present invention, the length of a belt to be wound by the electric winches can be reduced by reducing the front-rear length of the slope. Consequently, a diameter of a wind-up part in the electric winches can be reduced to achieve a reduction in size of the electric winches.

Also, the mounting device for the object to be mounted, according to the present invention, may be configured such that a size of the vehicle side plate in a direction perpendicular to the rotating shafts is set to be equal to a size of the ground side plate in the direction perpendicular to the rotating shafts.

According to the present invention, when the size L1 of the vehicle side plate in the direction perpendicular to the rotating shafts and the size L2 of the ground side plate in the direction perpendicular to the rotating shafts are set to be equal to each other (L1=L2), the main plate can be displaced (changed in position) between the low position and the high position with the angle of the main plate maintained at the predetermined angle. Consequently, stability of the object to be mounted at the time of displacement (change in position) of the main plate can be improved.

Moreover, the mounting device for the object to be mounted, according to the present invention, may be configured such that a size of the main plate in a direction perpendicular to the rotating shafts is set to be larger than a size of the vehicle side plate in the direction perpendicular to the rotating shafts and a size of the ground side plate in the direction perpendicular to the rotating shafts.

According to the present invention, when the size L3 of the main plate 34 in the direction perpendicular to the rotating shafts is set to be larger than the size L1 of the vehicle side plate and the size L2 of the ground side plate in the direction perpendicular to the rotating shafts (L3>L1, L2), a mountable range in which the object to be mounted can be stably displaced (changed in position) can be widely ensured, thereby improving the stability of the object to be mounted at the time of displacement of the slope.

If the above relationship of L3>L1, L2 is not satisfied, there is a possibility that the slope (main plate) is displaced in a state where the object to be mounted is mounted on the main plate and the vehicle side plate, stepping over one rotating shaft, or in a state where the object to be mounted is mounted on the main plate and the ground side plate, stepping over another rotating shaft. When the slope is displaced in the state where the object to be mounted is mounted stepping over the one or the other rotating shaft, there is a possibility that the object to be mounted is mounted only on the main plate and is in no contact with the vehicle side plate or the ground side plate to impair a smooth displacement of the object to be mounted on the slope.

Furthermore, the mounting device for the object to be mounted, according to the present invention, may be configured such that a total of a size of the vehicle side plate in a direction perpendicular to the rotating shafts, a size of the main plate in the direction perpendicular to the rotating shafts, and a size of the ground side plate in the direction perpendicular to the rotating shafts, is set to be larger than a size of a virtual straight line which connects the ground surface with a shaft center of the rotating shaft provided between the one end of the main plate and the vehicle body.

According to the present invention, when the total (L1+L2+L3) of the size L1 of the vehicle side plate, the size L3 of the main plate and the size L2 of the ground side plate is set to be larger than the size LV of the virtual straight line S which connects the ground surface with the shaft center of the rotating shaft provided between the one end of the main plate and the vehicle body ((L1+L2+L3)>LV), the slope can be displaced without moving the other end of the ground side plate which is in contact with the ground surface.

If the slope is displaced with a relationship of (L1+L2+L3)=LV, the other end of the ground side plate needs to be moved in a direction coming close to or getting away from the vehicle body and thus a frictional force is generated between the other end of the ground side plate and the ground surface. As a result, a problem occurs in that the generated friction force damages the other end of the ground side plate and/or the ground surface and applies an excess load to the slope at the time of displacement of the slope.

Furthermore, the mounting device for the object to be mounted, according to the present invention, may be configured such that when the main plate is in a state of the low position, an axial line in a vehicle front-rear direction of the main plate and an axial line in the vehicle front-rear direction of the ground side plate are set to be flush with each other.

According to the present invention, since there is no angle difference between the main plate and the ground side plate when moving the object to be mounted between the ground (road surface) and the slope at the low position, the object to be mounted can be smoothly moved to the main plate from the ground side plate when the object to be mounted is allowed to get in the vehicle, and can be smoothly moved to the ground side plate from the main plate when the object to be mounted is allowed to get out of the vehicle.

Furthermore, the mounting device for the object to be mounted, according to the present invention, may be configured such that when the main plate is in a state of the high position, an axial line in a vehicle front-rear direction of the vehicle side plate and an axial line in the vehicle front-rear direction of the main plate are set to be flush with each other.

According to the present invention, since there is no angle difference between the main plate and the vehicle side plate when moving the object to be mounted between the slope at the high position and the floor of the vehicle body, the object to be mounted can be smoothly moved to the vehicle side plate from the main plate when the object to be mounted is allowed to get in the vehicle, and can be smoothly moved to the main plate from the vehicle side plate when the object to be mounted is allowed to get out of the vehicle.

Furthermore, the mounting device for the object to be mounted, according to the present invention, may be configured to further include a grip portion which is provided on an upper surface of the ground side plate and is to be gripped by an operator.

According to the present invention, since the grip portion is located on the side of the vehicle body rear opening on the upper surface of the ground side plate in the housed state of the slope in the vehicle compartment, the slope can be easily gripped through the vehicle body rear opening.

Furthermore, the mounting device for the object to be mounted, according to the present invention, may be configured such that the vehicle side plate includes a first vehicle side plate and a second vehicle side plate, and the plurality of rotating shafts include a sub rotating shaft which is arranged between the first vehicle side plate and the second vehicle side plate, and a main rotating shaft which is arranged between the vehicle body and the first vehicle side plate, and wherein the first vehicle side plate is rotatably provided on the vehicle body with the main rotating shaft as a fulcrum of rotation.

According to the present invention, the main plate can be moved up and down by means of the sub rotating shaft and the entire slope including the first vehicle side plate can be rotated by means of the main rotating shaft. This makes it possible to arrange the main rotating shaft for housing and expanding the slope and the sub rotating shaft for moving up and down the main plate, separately at positions away from each other, respectively. Consequently, in the present invention, the rear portion of the vehicle body and the vehicle side plate can be suitably avoided from interfering with each other, for example, when the main plate is moved down. That is to say, interference of the vehicle side plate with the rear portion of the vehicle body can be avoided by arranging the main rotating shaft fixedly inside the vehicle body and arranging the sub rotating shaft outside the vehicle distanced from the main rotating shaft and displaced (distanced) from the vehicle body.

Furthermore, the mounting device for the object to be mounted, according to the present invention, may be configured to further include a rotating force urging means that is provided on the first vehicle side plate and the second vehicle side plate and assists rotating movement of the second vehicle side plate relative to the first vehicle side plate with the sub rotating shaft as a fulcrum of rotation.

According to the present invention, where the slope is housed inside the vehicle body, when the first upright stationary state in which the first vehicle side plate and the second vehicle side plate extend linearly, is shifted to the second upright stationary state in which the first vehicle side plate and the second vehicle sideplate are nearly perpendicular to each other, the first upright stationary state can be smoothly shifted to the second upright stationary state by assisting, through the rotating force urging means, the rotating movement of the second vehicle side plate relative to the first vehicle side plate.

Furthermore, the mounting device for the object to be mounted, according to the present invention, may be configured such that the plurality of rotating shafts include a main rotating shaft which rotates the entire slope, and to further include a shaft displacing means that is provided at a rear portion of the vehicle body and displaces the main rotating shaft in directions coming close to and getting away from the vehicle body.

According to the present invention, the slope can be moved to a position at which it can be housed in the vehicle body, by displacing the main rotating shaft in the direction coming close to the vehicle body, through the shaft displacing means. Moreover, when the main plate is moved up and down, it can be displaced to a position at which interference of the vehicle side plate with the rear portion of the vehicle body can be avoided, by displacing the main rotating shaft in the direction getting away from the vehicle body, through the shaft displacing means.

Furthermore, the mounting device for the object to be mounted, according to the present invention, may be configured such that the shaft displacing means is a bracket which is fixed to the vehicle body, and the bracket includes a holding portion which displaceably holds the main rotating shaft in the directions coming close to and getting away from the vehicle body, and a locking portion which locks the main rotating shaft in the directions coming close to and getting away from the vehicle body.

According to the present invention, at the time of housing the slope, the main rotating shaft can be locked at the position close to the vehicle body, and at the time of moving up and down the main plate, the main rotating shaft can be locked at the position away from the vehicle body.

Advantageous Effects of the Invention

The present invention makes it possible to obtain a mounting device for an object to be mounted, which is lightweight and inexpensive, and can also be applied to a vehicle having a high opening ground clearance.

Also, the present invention makes it possible to obtain a mounting device for an object to be mounted, which can avoid interference of a slope with a rear portion of a vehicle body.

DESCRIPTION OF EMBODIMENTS

Figure 1:
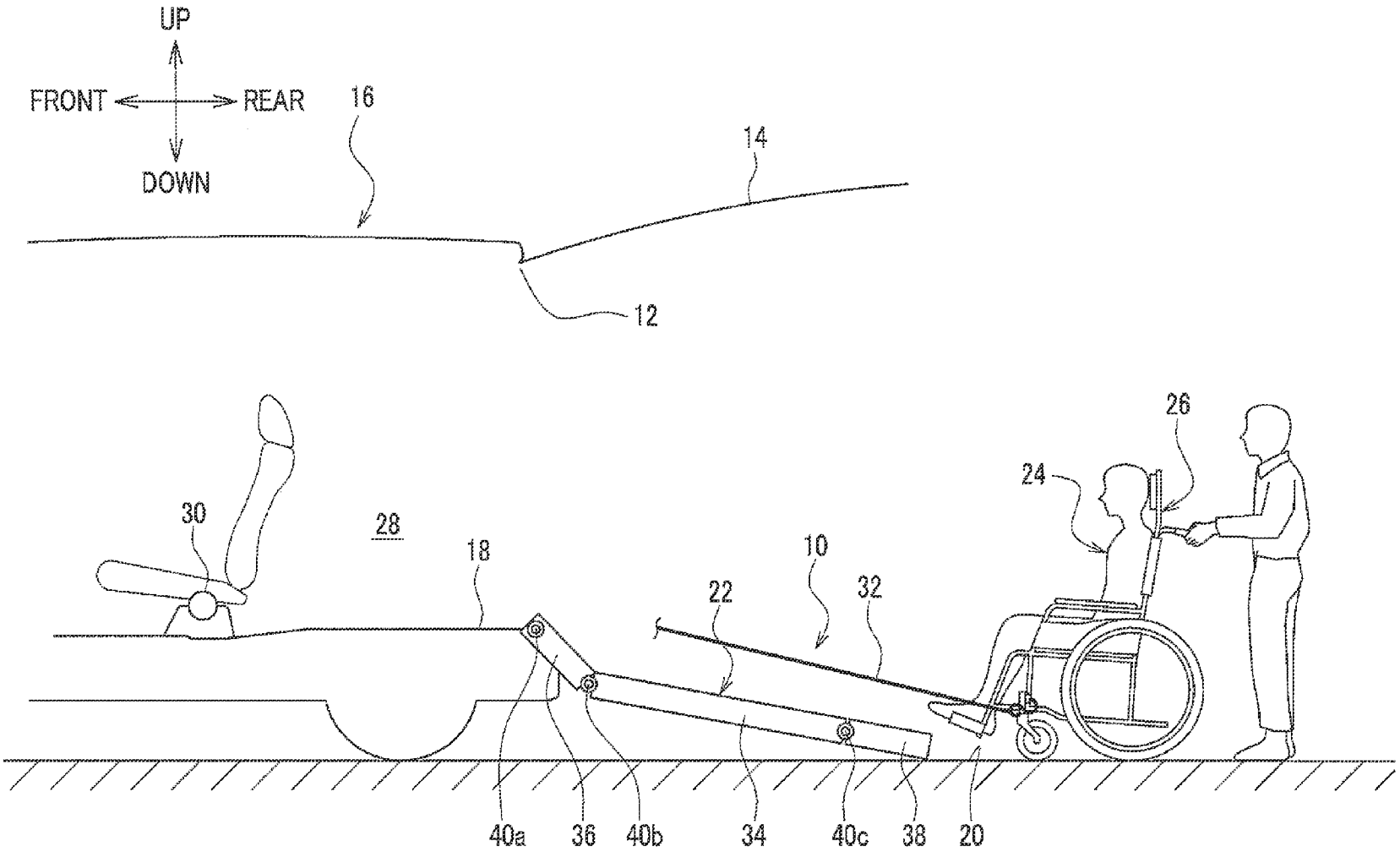
FIG. 1 is a side view of a state in which a mounting device according to an embodiment of the present invention is applied to a vehicle.
Figure 2:
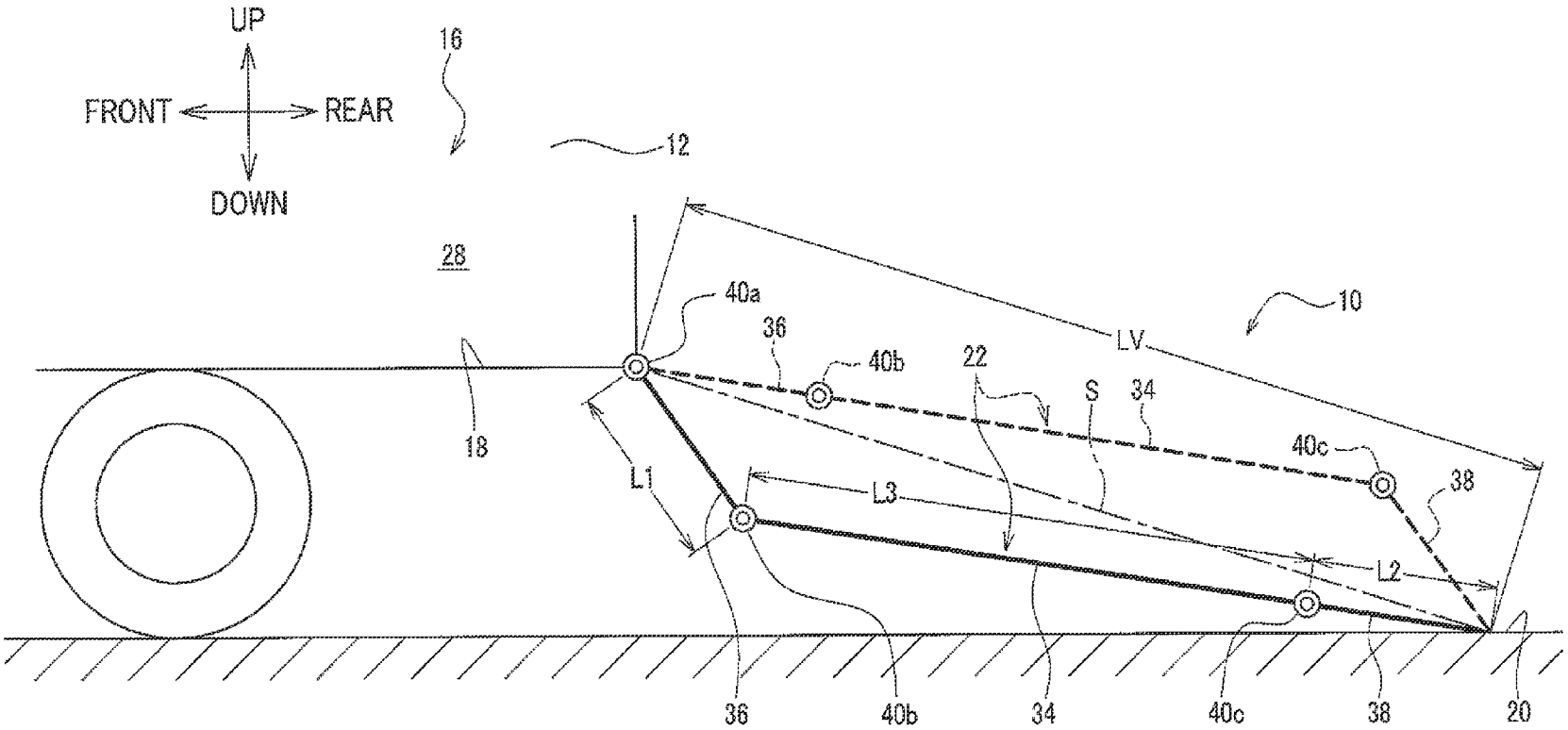
FIG. 2 is a schematic diagram of the vehicle and a slope shown in FIG. 1.

Next, embodiments of the present invention will be described in detail with reference to the drawings as appropriate. FIG. 1 is a side view of a state in which a mounting device according to an embodiment of the present invention is applied to a vehicle, and FIG. 2 is a schematic diagram of the vehicle and a slope shown in FIG. 1. Note that, "front-rear" and "up-down" indicated by arrows in each figure indicate a front-rear direction and an up-down direction (vertical up-down direction) of the vehicle, respectively, and "right-left" indicates a right-left direction (vehicle width direction) as viewed from a driver's seat.

As shown in FIG. 1, a mounting device 10 according to the embodiment of the present invention is applied, for example, to a vehicle 16 provided with a back door (tailgate) 14 for opening and closing a vehicle body rear opening 12. Note that the mounting device 10 is not limited to the vehicle 16 including the back door 14 and can also be applied to, for example, a vehicle including right and left rear doors (not shown).

The mounting device 10 includes a slope 22 which is bridged between a floor surface 18 of the vehicle body rear opening 12 and a ground surface (road surface) 20. The slope 22 is for pulling a wheelchair (object to be mounted) 26 in which a cared person 24 sits, into a rear compartment space 28, and is for pulling out the wheelchair 26 to the outside of the vehicle.

A pair of right and left electric winches 30 is provided in a compartment of the vehicle 16. The pair of right and left electric winches 30 includes a drum (not shown) capable of winding and pulling out a belt 32 which is engaged with the wheelchair 26, and is capable of pulling the wheelchair 26 in which the cared person 24 sits, into the rear compartment space 28. Incidentally, the pair of right and left electric winches 30 is arranged, for example, between a seat and a vehicle body along the vehicle width direction.

As shown in FIG. 2, the slope 22 is composed of a main plate 34 on which the wheelchair 26 is mounted, a vehicle side plate 36 made of a plate which is provided between one end on the vehicle front side of the main plate 34 and the vehicle body rear opening (vehicle body) 12, and a ground side plate 38 made of a plate which is provided between another end on the vehicle rear side of the main plate 34 and the ground surface 20.

The main plate 34, the vehicle side plate 36 and the ground side plate 38 are made of a rectangular flat plate in a plan view, respectively, and may be configured, for example, in the form of a hollow body of a resin material or a light metal material. This is intended for a reduction in weight of the slope 22.

In the present embodiment, the main plate 34 is composed of a single plate, but the main plate 34 may be composed of, for example, the entire plural plates which are laid out so that adjacent plural plates slide to each other. Moreover, the vehicle side plate 36 and the ground side plate 38 are not limited to a single plate, respectively, and may be composed of plural plates (see FIG. 11 to be described later).

Figure 5:
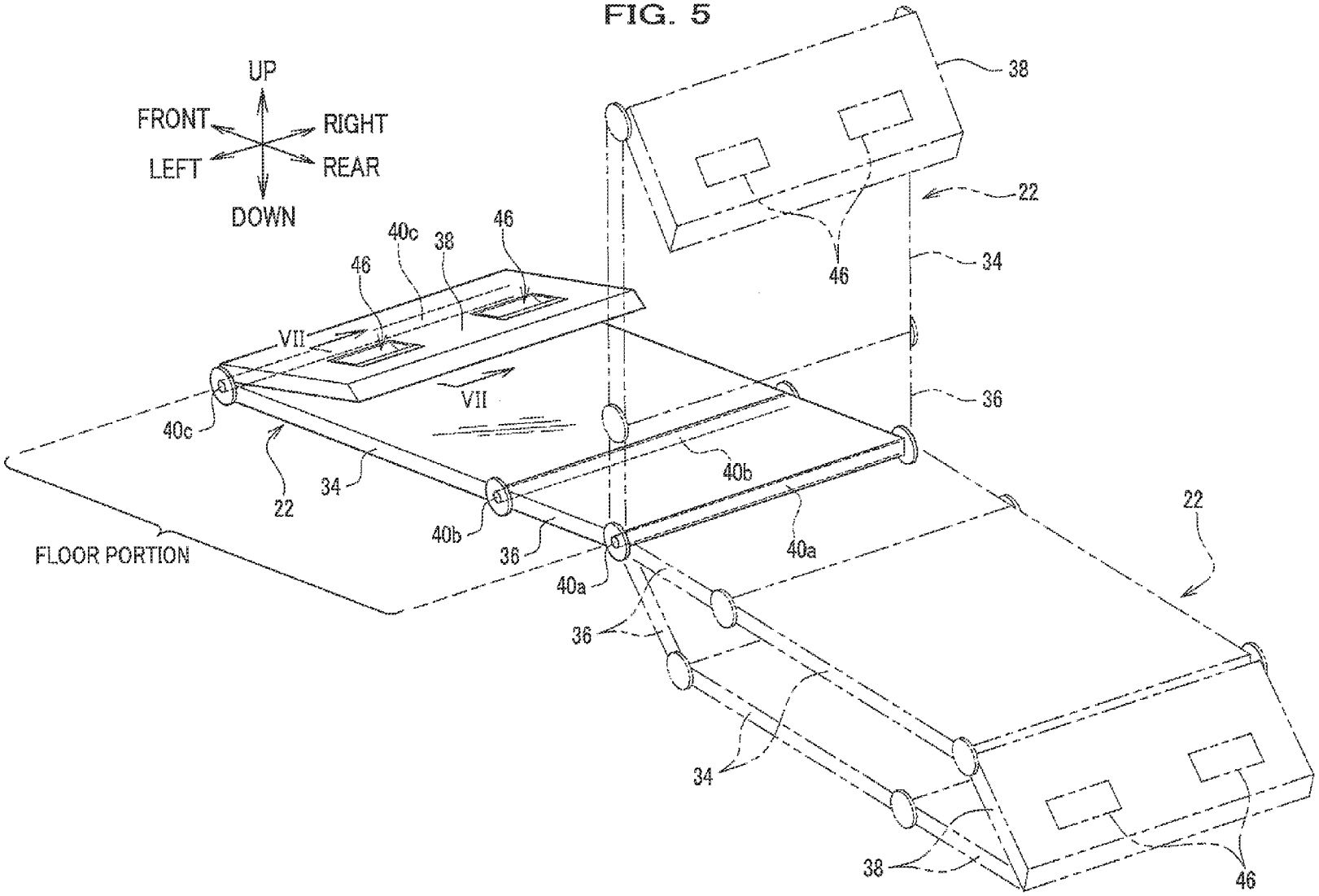
FIG. 5 is an explanatory view showing a housed state, an upright stationary state and a grounded state of the slope.

As shown in FIGS. 1, 2 and 5, provided between the floor surface 18 of the vehicle 16 and the vehicle side plate 36 is a first rotating shaft 40*a* which extends in the vehicle width direction. The vehicle sideplate 36 is rotatably coupled to the floor surface 18 on a fixed side with a shaft center of the first rotating shaft 40*a* as a rotation center. Also, provided between the vehicle side plate 36 and the main plate 34 is a second rotating shaft 40*b* which extends in the vehicle width direction. The vehicle side plate 36 and the main plate 34 are rotatably coupled to each other with a shaft center of the second rotating shaft 40*b* as a rotation center. Moreover, provided between the main plate 34 and the ground side plate 38 is a third rotating shaft 40*c* which extends in the vehicle width direction. The main plate 34 and the ground side plate 38 are rotatably coupled to each other with a shaft center of the third rotating shaft 40*c* as a rotation center.

As shown in FIG. 2, a size L1 of the vehicle side plate 36 in a direction (vehicle front-rear direction) perpendicular to the first to third rotating shafts 40*a* to 40*c* is set to be equal to a size L2 of the ground side plate 38 in the direction (vehicle front-rear direction) perpendicular to the first to third rotating shafts 40*a* to 40*c* (L1=L2). In other words, the size L1 of the vehicle side plate 36 and the size L2 of the ground side plate 38 are set to be equal to each other.

When the size L1 of the vehicle side plate 36 and the size L2 of the ground side plate 38 are set to be equal to each other (L1=L2), the main plate 34 can be displaced (changed in position) between a low position (see a thick solid line in FIG. 2) and a high position (see a thick broken line in FIG. 2) with an angle of the main plate 34 maintained at a predetermined angle. Consequently, stability of the wheelchair 26 at the time of displacement (change in position) of the main plate 34 can be improved.

As shown in FIG. 2, a size L3 of the main plate 34 in the direction (vehicle front-rear direction) perpendicular to the first to third rotating shafts 40*a* to 40*c* is set to be larger than the size L1 of the vehicle side plate 36 in the direction (vehicle front-rear direction) perpendicular to the first to third rotating shafts 40*a* to 40*c* and the size L2 of the ground side plate 38 in the direction (vehicle front-rear direction) perpendicular to the first to third rotating shafts 40*a* to 40*c* (L3>L1, L2).

When the size L3 of the main plate 34 is set to be larger than the size L1 of the vehicle side plate 36 and the size L2 of the ground side plate 38 (L3>L1, L2), a mountable range (mountable area) in which the wheelchair 26 can be stably displaced (changed in position) can be widely ensured, thereby improving the stability of the wheelchair 26 at the time of displacement of the slope 22. This point will be described in detail later.

The total (L1+L2+L3) of the size L1, the size L2 and the size L3 shown in FIG. 2 is set to be larger than a size LV of a virtual straight line S (see a thin one-dot chain line in FIG. 2) which connects the ground surface 20 with the shaft center of the first rotating shaft 40*a* provided between the one end on the vehicle front side of the main plate 34 and the vehicle body ((L1+L2+L3)>LV). Note that the size L1 is the size of the vehicle side plate 36 in the direction (vehicle front-rear direction) perpendicular to the first to third rotating shafts 40*a* to 40*c*; the size L3 is the size of the main plate 34 in the direction (vehicle front-rear direction) perpendicular to the first to third rotating shafts 40*a* to 40*c*; and the size L2 is the size of the ground side plate 38 in the direction (vehicle front-rear direction) perpendicular to the first to third rotating shafts 40*a* to 40*c*.

When the total (L1+L2+L3) of the size L1 of the vehicle side plate 36, the size L3 of the main plate 34 and the size L2 of the ground side plate 38 is set to be larger than the size LV of the virtual straight line S ((L1+L2+L3)>LV), the slope 22 can be displaced without moving the other end of the ground side plate 38 which is in contact with the ground surface 20. This point will be described in detail later.

The mounting device 10 includes drive mechanisms (drive means) 42 (see FIGS. 3 and 4) for rotating the first to third rotating shafts 40*a* to 40*c*, respectively. Moreover, the mounting device 10 includes switching mechanisms (switching means) 44 (see FIGS. 3 and 4) for switching between a rotatable state in which driving forces by the drive mechanisms 42 are transmitted to allow the first to third rotating shafts 40*a* to 40*c* to be in the rotatable state, and a non-rotatable state in which transmission of the driving forces by the drive mechanisms 42 is interrupted to allow the first to third rotating shafts 40*a* to 40*c* to be in the non-rotatable state.

The slope 22 is provided to allow the main plate 34 to be displaced between the low position (position of the thick solid line in FIG. 2) and the high position (position of the thick broken line in FIG. 2) in the up-down direction by rotating the first to third rotating shafts 40*a* to 40*c* with the drive mechanisms 42. The main plate 34 is moved parallel along the up-down direction between the low position and the high position, with an inclination angle thereof maintained at the predetermined angle.

When the main plate 34 is in a state of the low position (position of the thick solid line in FIG. 2) in the up-down direction, an axial line in the vehicle front-rear direction of the main plate 34 and an axial line in the vehicle front-rear direction of the ground side plate 38 are set to be flush with each other. When the main plate 34 is in the state of the low position, an axial line in the vehicle front-rear direction of the vehicle side plate 36 is set to a state of being inclined by a predetermined angle downwardly to the side of the main plate 34 (vehicle rear side).

When the main plate 34 is in a state of the high position (position of the thick broken line in FIG. 2) in the up-down direction, the axial line in the vehicle front-rear direction of the vehicle side plate 36 and the axial line in the vehicle front-rear direction of the main plate 34 are set to be flush with each other. When the main plate 34 is in the state of the high position, the axial line in the vehicle front-rear direction of the ground side plate 38 is set to a state of being inclined by a predetermined angle downwardly to the vehicle rear side.

The drive mechanisms 42 are respectively provided to the first to third rotating shafts 40*a* to 40*c*, and each of the drive mechanisms 42 is configured to be the same. For this reason, the drive mechanism 42 for rotating the third rotating shaft 40*c* will be described in detail, and description of the drive mechanisms 42 for rotating the first rotating shaft 40*a* and the second rotating shaft 40*b* will be omitted.

Figure 3:
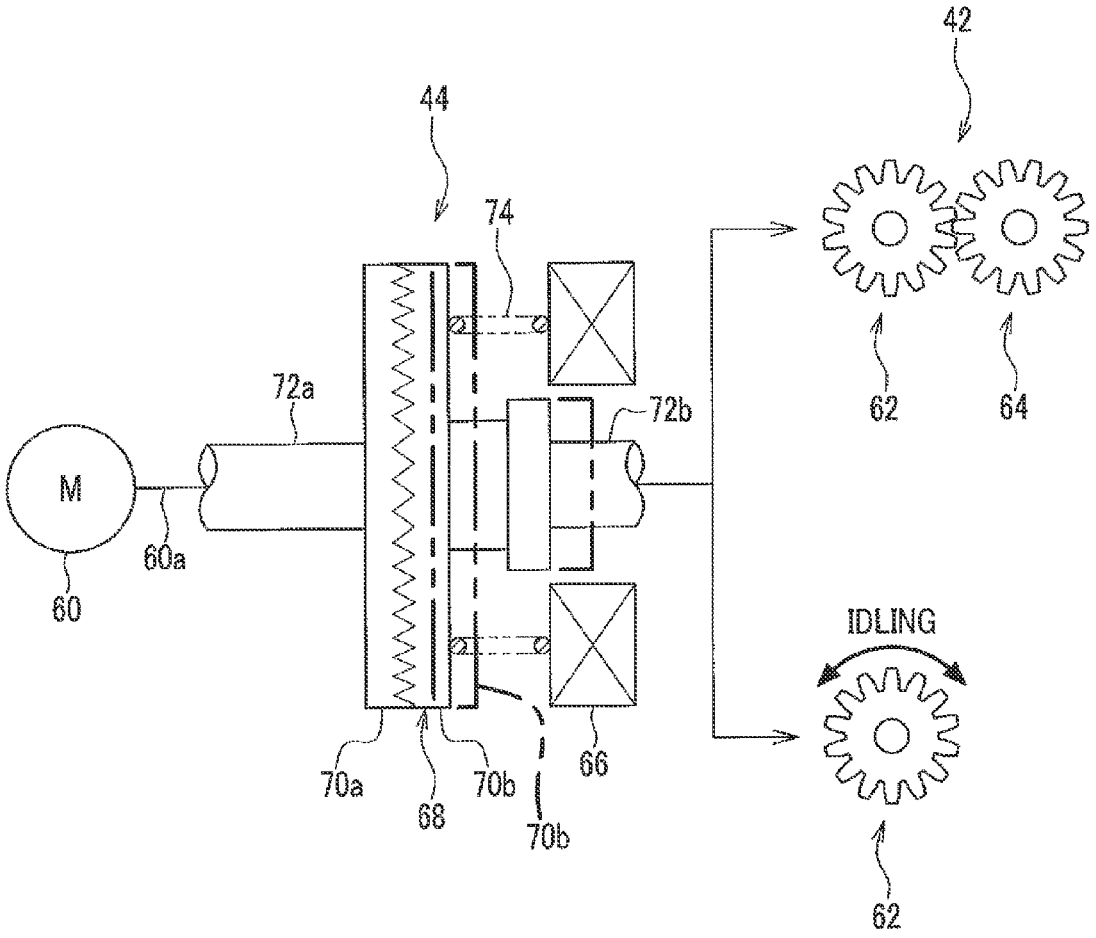
FIG. 3 is a schematic view showing a configuration of a drive mechanism for rotating a rotating shaft and a switching mechanism for switching between a rotatable state and a non-rotatable state of the rotating shaft.
Figure 4:
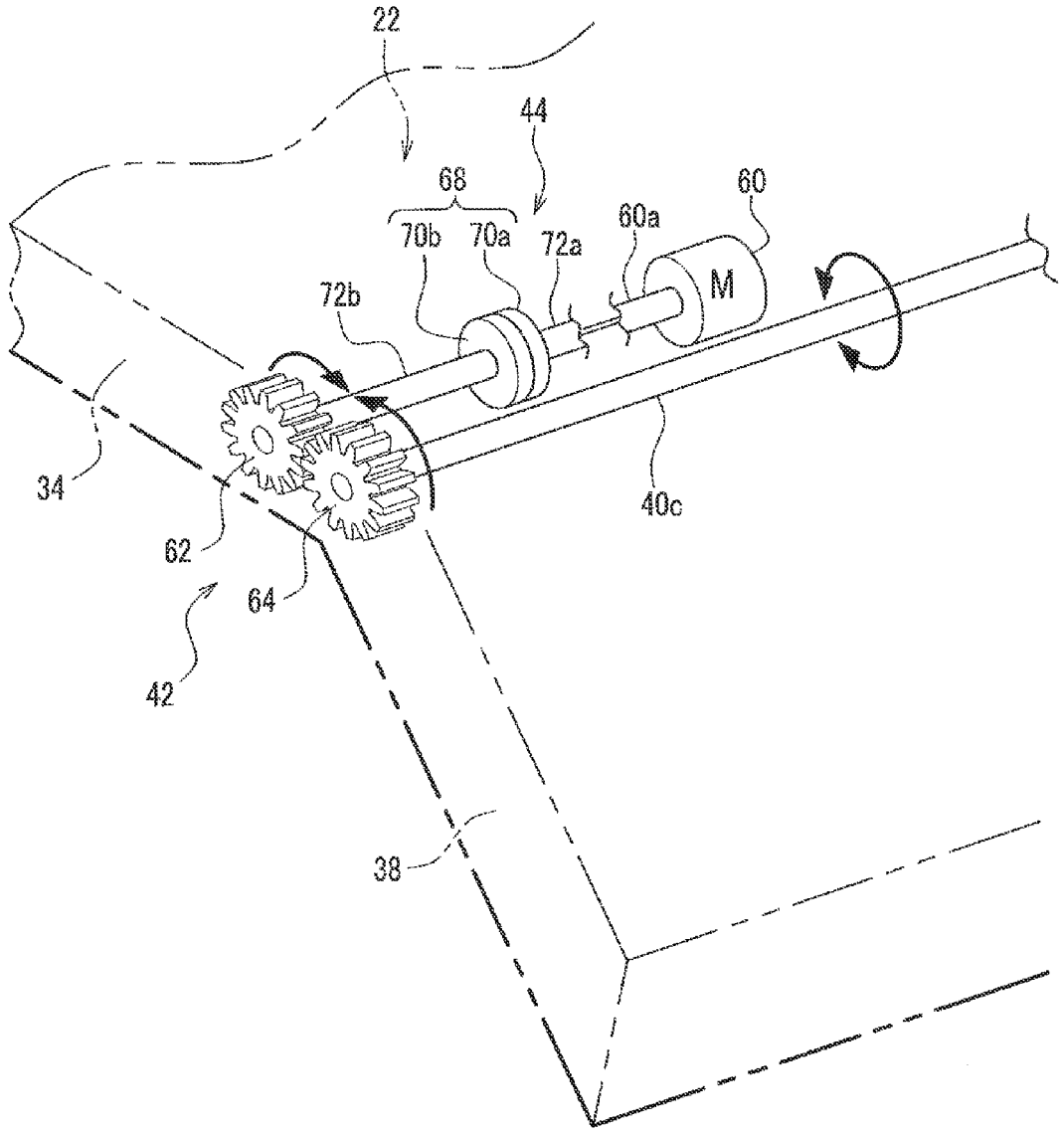
FIG. 4 is a schematic structural perspective view showing a state in which the drive mechanism and the switching mechanism are applied to a third rotating shaft.

FIG. 3 is a schematic view showing a configuration of the drive mechanism for rotating the rotating shaft and the switching mechanism for switching between the rotatable state and the non-rotatable state of the rotating shaft, and FIG. 4 is a schematic structural perspective view showing a state in which the drive mechanism and the switching mechanism are applied to the third rotating shaft.

As shown in FIGS. 3 and 4, the drive mechanism 42 includes a motor 60 for rotating a motor shaft 60*a* in the forward or reverse direction with a battery (not shown) as a power supply, a driving gear 62 which is coupled to the motor 60 via the switching mechanism 44, and a driven gear 64 which is coupled to the first to third rotating shafts 40*a* to 40*c* and is arranged to be able to mesh with the driving gear 62. Described supplementally, the drive mechanism 42 and the switching mechanism 44 shown in FIG. 3 are provided each one for the first rotating shaft 40*a*, the second rotating shaft 40*b* and the third rotating shaft 40*c*, respectively. Further, the drive mechanisms 42 and the switching mechanisms 44 are cooperatively controlled, respectively.

As shown in FIG. 3, the switching mechanism 44 is configured, for example, as an electromagnetic clutch 68 to which a solenoid 66 is attached. The clutch 68 includes the solenoid 66 which is wound with a layered coil, a pair of disc-shaped clutch plates 70*a*, 70*b* which are arranged to be able to be coupled (connected) to and spaced from each other while concave-convex surfaces thereof face each other, a pair of shafts 72*a*, 72*b* which are coupled to center portions of the pair of clutch plates 70*a*, 70*b*, respectively, and a spring member 74 which couples (connects) one clutch plate 70*a* to the other clutch plate 70*b* by depressing the other clutch plate 70*b* by its spring force. Note that, the other clutch plate 70*b* in proximity to the solenoid 66 is adapted to function as a movable iron core (armature) which is attracted to the solenoid 66.

The one clutch plate 70*a* is coupled to the motor shaft 60*a* via a coupling member (not shown), and the other clutch plate 70*b* is coupled to the driving gear 62 via the shaft 72*b*. In an ON state of the clutch 68 in which the one clutch plate 70*a* and the other clutch plate 70*b* are coupled to each other, when the solenoid 66 is energized to generate an electromagnetic force by its excitation, the other clutch plate 70*b* is attracted to the side of the solenoid 66 by the electromagnetic force. When the other clutch plate 70*b* is attracted to the side of the solenoid 66, the other clutch plate 70*b* is spaced from the one clutch plate 70*a* by a predetermined distance, thereby allowing the clutch 68 to be in an OFF state.

In the ON state of the clutch 68, the driving gear 62 and the driven gear 64 are meshed with each other, and a rotation driving force by the energized motor 60 is transmitted to the third rotating shaft 40*c*, to allow the third rotating shaft 40*c* to rotate in a predetermined direction. In contrast, in the OFF state of the clutch 68, the driving gear 62 is spaced from the driven gear 64 to be brought into a non-meshed state (the driving gear 62 is brought into an idling state), and the rotation driving force by the motor 60 is interrupted not to be transmitted to the third rotating shaft 40*c*.

Figure 7:
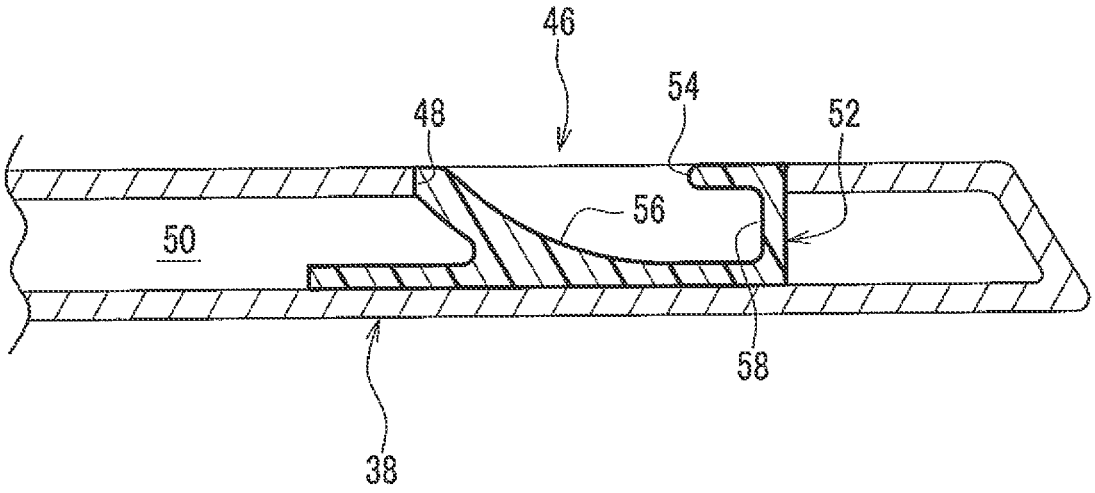
FIG. 7 is a vertical sectional view taken along the line VII-VII in FIG. 5.

FIG. 7 is a vertical sectional view taken along the line VII-VII in FIG. 5.

Provided on the upper surface of the ground side plate 38 is a pair of right and left grip portions 46 which are to be gripped, for example, by a support person (operator) or the like. As shown in FIG. 7, each grip portion 46 includes a casing 52 which is inserted through a rectangular opening 48 of the ground side plate 38 to be housed in a hollow portion 50. The casing 52 includes an engaging projection 54 which projects along the upper surface of the ground side plate 38, a curved portion 56 having a curved surface which is gently curved toward a lower surface from the upper surface of the ground side plate 38, and a vertical wall 58 which connects the engaging projection 54 with the curved portion 56.

Figure 6:
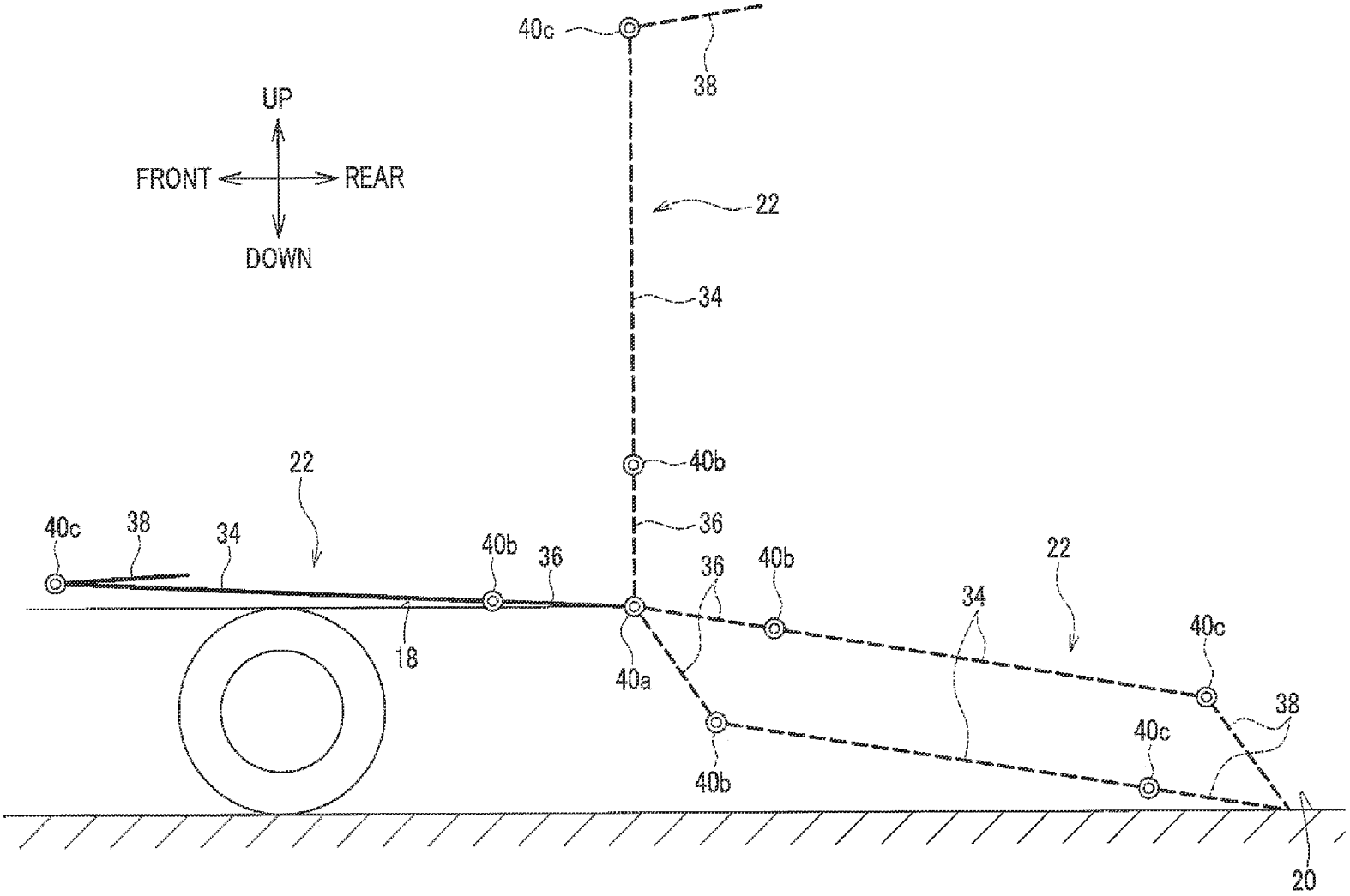
FIG. 6 is a schematic diagram showing the housed state, the upright stationary state and the grounded state of the slope.

FIG. 5 is an explanatory view showing a housed state of the slope in the vehicle compartment, an upright stationary state of the slope, and a grounded state in which the slope is moved outside the vehicle and the other end of the slope is grounded to the ground surface, and FIG. 6 is a schematic diagram showing each state described above, respectively.

After moving the slope 22 outside the vehicle via the upright stationary state from the housed state, the slope 22 is brought into the grounded state in which the other end in the vehicle front-rear direction of the slope 22 is grounded to the ground surface 20. In the housed state of the slope 22 in the vehicle compartment, the main plate 34 and the vehicle side plate 36 are in a substantially horizontal state, while the ground side plate 38 is in a state of being folded starting from the third rotating shaft 40*c* with an acute angle relative to the main plate 34 and the vehicle side plate 36. In this housed state, as shown in FIG. 5, since the pair of grip portions 46 is provided at positions close to the vehicle body rear opening 12 (see FIG. 1) on the upper surface of the ground side plate 38, the support person is allowed to grip the grip portions 46 from outside the vehicle through the vehicle body rear opening 12, to easily ground the slope 22, for example, without entering into the vehicle compartment.

The mounting device 10 according to the present embodiment is basically configured as described above, and its operation and advantageous effects will be described below.

Figure 8:
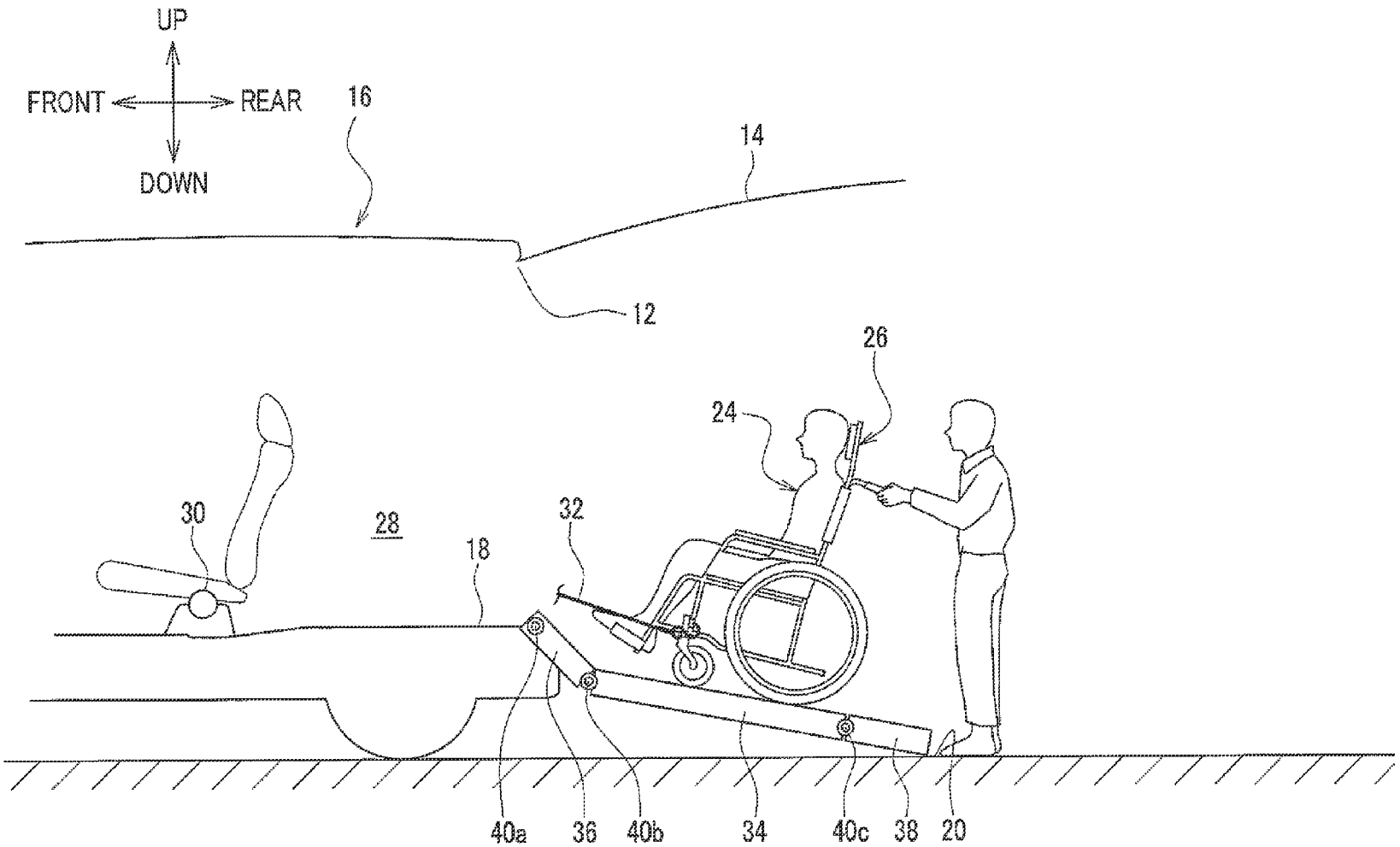
FIG. 8 is a side view showing a state in which a wheelchair is mounted on a main plate at a low position after the wheelchair moves from a state shown in FIG. 1.
Figure 9:
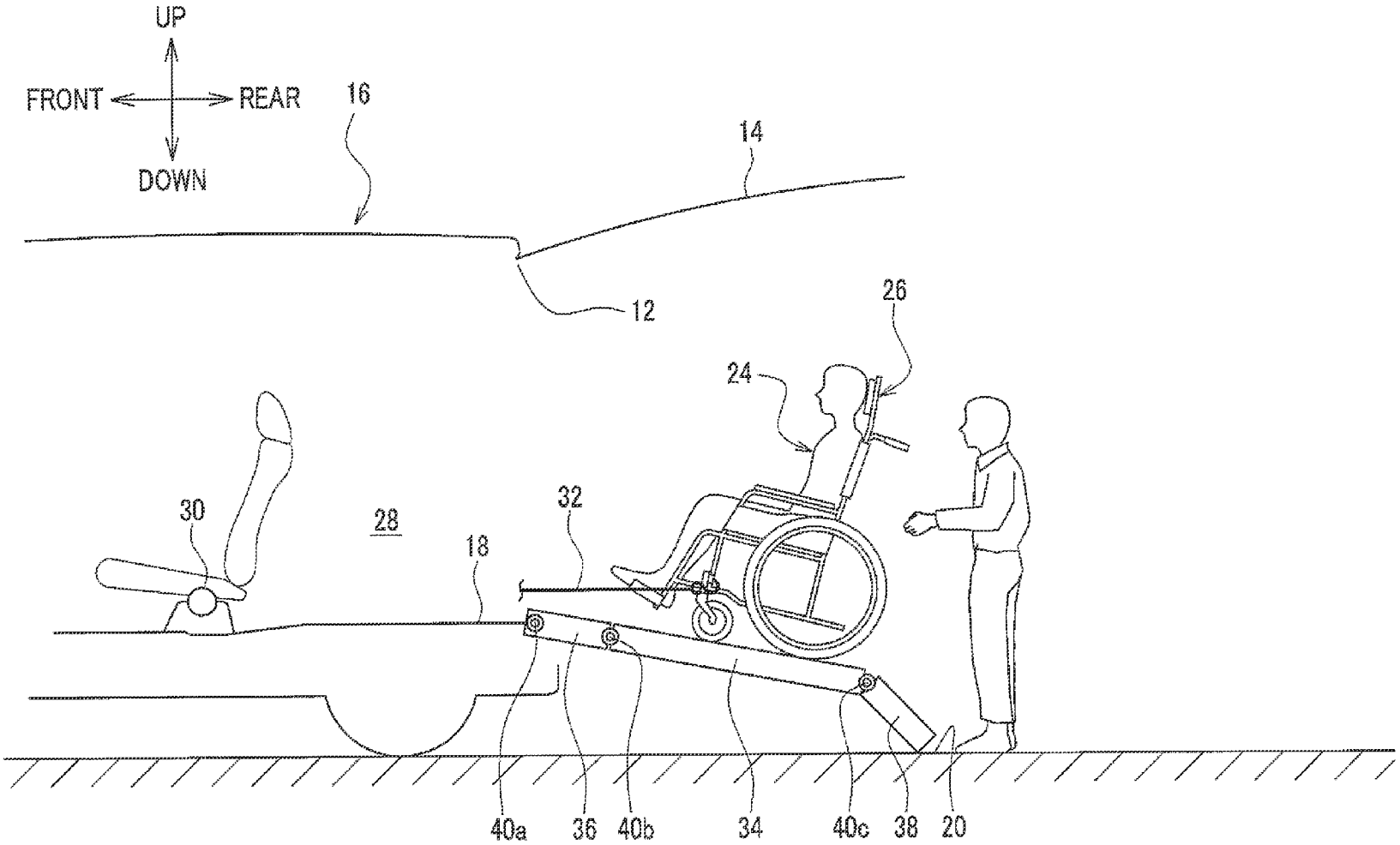
FIG. 9 is a side view showing a state in which the main plate is displaced to a high position from the low position while the wheelchair is mounted on the main plate.
Figure 10:
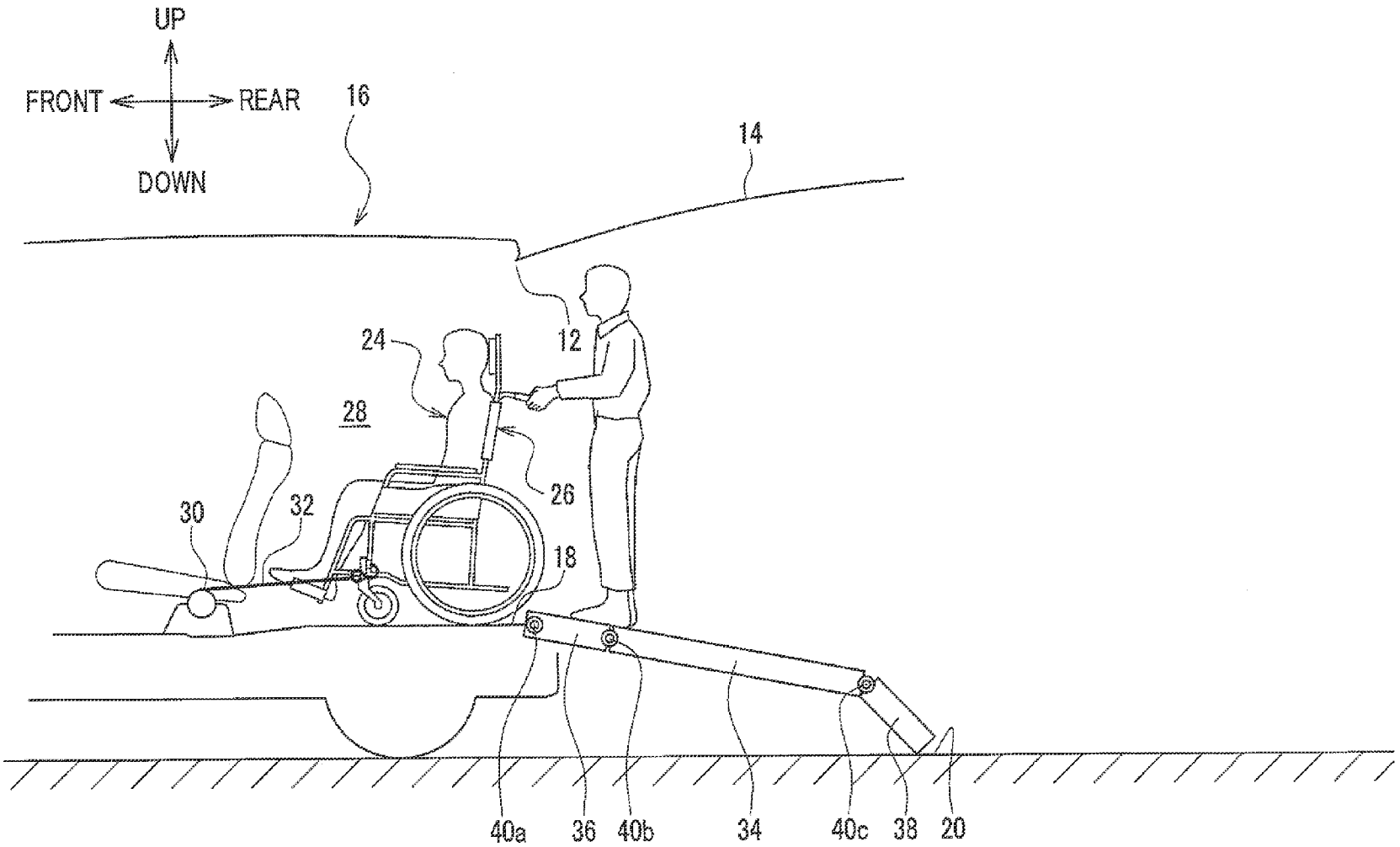
FIG. 10 is a side view showing a state in which the wheelchair has moved to reach a rear compartment space.

FIG. 8 is a side view showing a state in which the wheelchair is mounted on the main plate at the low position after the wheelchair moves from a state shown in FIG. 1; FIG. 9 is a side view showing a state in which the main plate is displaced to the high position from the low position while the wheelchair is mounted on the main plate; and FIG. 10 is a side view showing a state in which the wheelchair has moved to reach the rear compartment space.

First, as shown in FIG. 1, the slope 22 housed in the vehicle compartment is moved outside the vehicle and is then bridged between the vehicle body and the ground surface 20 so that the main plate 34 is at the low position in the up-down direction. At this low position, the axial line in the vehicle front-rear direction of the main plate 34 and the axial line in the vehicle front-rear direction of the ground side plate 38 are set to be flush with each other, while the axial line in the vehicle front-rear direction of the vehicle side plate 36 is set to a state of being inclined by the predetermined angle downwardly to the side of the main plate 34 (vehicle rear side).

Subsequently, in the state of the slope 22 (main plate 34) being at the low position, when the electric winches 30 are activated, for example, by remote control (not shown) by the support person, to wind up the belt 32 which is engaged with the wheelchair 26, by means of the drum (not shown), the cared person 24 is moved to the vehicle body side along the slope 22 while sitting in the wheelchair 26. As shown in FIG. 8, when the wheelchair 26 is brought into a state mounted on the main plate 34, a winding operation of the drum by the electric winches 30 is stopped under control of a control unit (not shown).

Subsequently, in response to remote control (not shown) by the support person, the control unit (not shown) rotates the first to third rotating shafts 40*a* to 40*c* in a predetermined direction, respectively, to switch the main plate 34 to the state of the high position from the state of the low position, while maintaining the state in which the wheelchair 26 is mounted on the main plate 34 as shown in FIG. 9. More specifically, the control unit (not shown) rotates the first rotating shaft 40*a* and the second rotating shaft 40*b* in the predetermined direction, to allow the axial line in the vehicle front-rear direction of the vehicle side plate 36 and the axial line in the vehicle front-rear direction of the main plate 34 to be flush with each other. At the same time, the control unit (not shown) rotates the third rotating shaft 40*b* to allow the axial line in the vehicle front-rear direction of the ground side plate 38 to be in a state of being inclined by the predetermined angle downwardly to the vehicle rear side.

At the end, while maintaining the state in which the wheelchair 26 is mounted on the main plate 34 at the high position, when the electric winches 30 are activated again by remote control (not shown) by the support person to start winding of the belt 32, and the support person presses the wheelchair 26 to the vehicle body side along the slope 22, the wheelchair 26 can be got in a position of the rear compartment space 28 (see FIG. 10). Note that the winding of the belt 32 by the electric winches 30 is stopped when the wheelchair 26 reaches the position of the rear compartment space 28.

Where the wheelchair 26 in which the cared person sits is allowed to get out of the rear compartment space 26, the operation is reverse to the above-described operation, and the wheelchair 26 can be easily got out by switching the main plate 34 of the slope 22 to the low position from the high position. Further, by placing the slope 22 in the housed state from the grounded state via the upright stationary state while the support person grips the grip portions 46, the slope 22 can be easily housed in the vehicle compartment.

In the present embodiment, the main plate 34 can be moved parallel along the up-down direction between the low position and the high position, with the inclination angle of the main plate 34 maintained at the predetermined angle. Therefore, in the present embodiment, the main plate 34 constituting the slope 22 can be stably displaced (changed in position) between the low position and the high position, without moving the other end of the ground side plate 38 which is grounded to the ground surface 20. In other words, the main plate 34 is allowed to move parallel in the up-down direction between the low position and the high position, while constantly maintaining a posture of the cared person 24 sitting in the wheelchair 26 (object to be mounted) (maintaining a stationary state of the wheelchair 26). Consequently, the present embodiment makes it possible to suitably prevent a load from being applied to the main plate 34 at the time of displacement of the main plate 34, without generating a frictional force between the other end of the ground side plate 38 and the ground surface 20.

Also, when the slope 22 is provided on the vehicle 16 in which an opening ground clearance of the tailgate (back door 14) at the rear portion of the vehicle body is high, for example, such as a hybrid vehicle or an electric vehicle provided with a battery or the like on a floor surface thereof, the wheelchair 26 can be got in the vehicle and got out of the vehicle with a low load, without increasing an inclination angle of the slope 22 or increasing a front-rear length of the slope 22.

Further, since it is unnecessary to increase the front-rear length of the slope 22, an expansion space of the slope 22 in the grounded state can be reduced, thereby improving the convenience.

Consequently, in the present embodiment, the slope 22 can be made lightweight and inexpensive by making itself a simple structure, and the slope 22 can also be suitably applied to the vehicle 16 having a high ground clearance of the opening bottom of the tailgate by stably displacing (changing the position of) the main plate 34 on which the wheelchair 26 is mounted, between the low position and the high position.

In the present embodiment, since the wheelchair 26 can be got in the vehicle with a lower load by attaching the electric winches 30, a lifting force for the wheelchair 26 by the electric winches 30 can be reduced to avoid an increase in size of the electric winches 30. Also, in the present embodiment, the length of the belt 32 to be wound by the electric winches 30 can be reduced by reducing the front-rear length of the slope 22. Consequently, a diameter of the drum in the electric winches 30 can be reduced to achieve a reduction in size of the electric winches 30.

Further, in the present embodiment, when the size L1 of the vehicle side plate 36 in the direction (vehicle front-rear direction) perpendicular to the first to third rotating shafts 40*a* to 40*c* and the size L2 of the ground side plate 38 in the direction (vehicle front-rear direction) perpendicular to the first to third rotating shafts 40*a* to 40*c* are set to be equal to each other (L1=L2), the main plate 34 can be displaced (changed in position) between the low position and the high position with the angle of the main plate 34 maintained at the predetermined angle. Consequently, stability of the wheelchair 26 at the time of displacement (change in position) of the main plate 34 can be improved.

Moreover, in the present embodiment, when the size L3 of the main plate 34 in the direction (vehicle front-rear direction) perpendicular to the first to third rotating shafts 40*a* to 40*c* is set to be larger than the size L1 of the vehicle side plate 36 and the size L2 of the ground side plate 38 in the direction (vehicle front-rear direction) perpendicular to the first to third rotating shafts 40*a* to 40*c* (L3>L1, L2), the mountable range in which the wheelchair 26 can be stably displaced (changed in position) can be widely ensured, thereby improving the stability of the wheelchair 26 at the time of displacement of the slope 22.

If the above relationship of L3>L1, L2 is not satisfied, there is a possibility that the slope 22 (main plate 34) is displaced, for example, in a state where the wheelchair 26 is mounted on the main plate 34 and the vehicle sideplate 36, stepping over the second rotating shaft 40*b*, or in a state where the wheelchair 26 is mounted on the main plate 34 and the ground side plate 38, stepping over the third rotating shaft 40*c*. When the slope 22 is displaced in the state where the wheelchair 26 is mounted stepping over the second rotating shaft 40*b* or the third rotating shaft 40*c*, there is a possibility that the wheelchair 26 is mounted only on the main plate 34 to impair a smooth displacement thereof on the slope 22.

Furthermore, in the present embodiment, when the total (L1+L2+L3) of the size L1 of the vehicle side plate 36, the size L3 of the main plate 34 and the size L2 of the ground side plate 38 is set to be larger than the size LV of the virtual straight line S which connects the ground surface 20 with the shaft center of the first rotating shaft 40*a* provided between the one end of the main plate 34 and the vehicle body ((L1+L2+L3)>LV), the slope 22 can be displaced without moving the other end of the ground side plate 38 which is in contact with the ground surface 20.

If the slope 22 is displaced in a state where the slope 22 is set to satisfy a relationship of (L1+L2+L3)=LV or a relationship of (L1+L2+L3)<LV, the other end of the ground side plate 38 needs to be moved in a direction coming close to or getting away from the vehicle body and thus a frictional force is generated between the other end of the ground side plate 38 and the ground surface 20. As a result, a problem occurs in that the generated friction force damages the other end of the ground side plate 38 and/or the ground surface 20 and applies an excess load to the slope 22 at the time of displacement of the slope 22.

Further, in the present embodiment, since there is no angle difference between the main plate 34 and the ground side plate 38 when moving the wheelchair 26 between the ground (road surface) and the slope 22 at the low position, the wheelchair 26 can be smoothly moved to the main plate 34 from the ground side plate 38 when the wheelchair 26 is allowed to get in the vehicle, and can be smoothly moved to the ground side plate 38 from the main plate 34 when the wheelchair 26 is allowed to get out of the vehicle.

Moreover, in the present embodiment, since there is no angle difference between the main plate 34 and the vehicle side plate 36 when moving the wheelchair 26 between the slope 22 at the high position and the floor surface 18 of the vehicle body, the wheelchair 26 can be smoothly moved to the vehicle side plate 36 from the main plate 34 when the wheelchair 26 is allowed to get in the vehicle, and can be smoothly moved to the main plate 34 from the vehicle side plate 36 when the wheelchair 26 is allowed to get out of the vehicle.

Furthermore, in the present embodiment, since the grip portions 46 are located on the side of the vehicle body rear opening 12 on the upper surface of the ground side plate 38 in the housed state of the slope 22 in the vehicle compartment, the slope 22 can be easily gripped through the vehicle body rear opening 12.

Next, a mounting device 10*a* according to another embodiment of the present invention will be described below.

Figure 11:
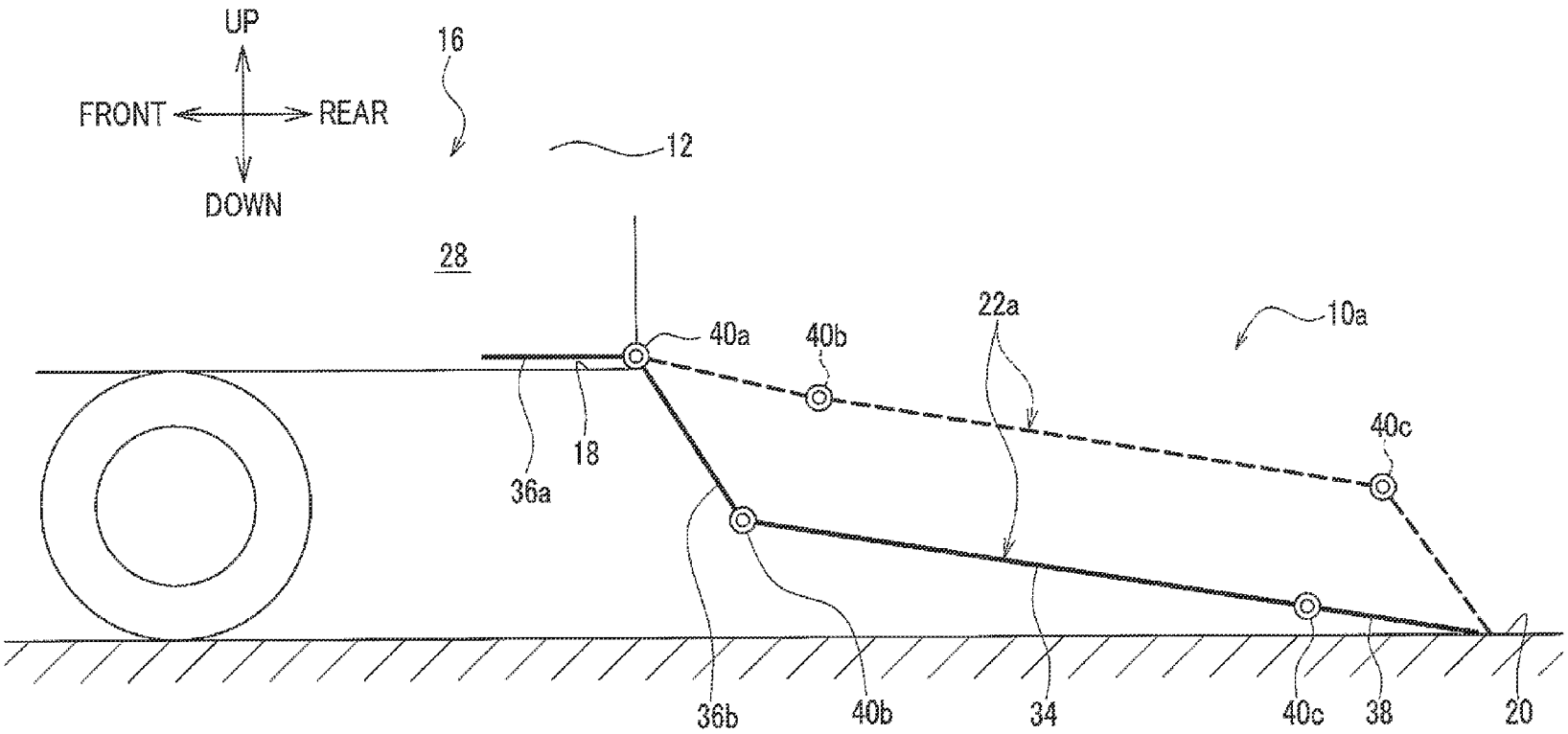
FIG. 11 is a schematic diagram of a vehicle and a slope on which a mounting device according to another embodiment of the present invention is mounted.

FIG. 11 is a schematic diagram of a vehicle and a slope to which a mounting device according to another embodiment of the present invention is applied. Note that, in other embodiments to be described later, the same components as in the embodiment shown in FIG. 2 are denoted by the same reference signs and thus detailed description thereof will be omitted.

In the embodiment described above shown in FIG. 2, the vehicle side plate 36 arranged between the one end in the vehicle front-rear direction of the main plate 34 and the vehicle body is composed of a single plate, while the mounting device 10*a* according to the other embodiment is different from the embodiment described above in that the vehicle side plate 36 is composed of plural plates of a first vehicle side plate 36*a* and a second vehicle side plate 36*b*.

The first vehicle side plate 36*a* is coupled to the first rotating shaft 40*a* and is provided on the floor surface 18 in the vehicle front direction from the first rotating shaft 40*a*. The second vehicle side plate 36*b* is coupled to the first rotating shaft 40*a* and is coupled to the main plate 34 via the second rotating shaft 40*b* at a position on the vehicle rear side of the first rotating shaft 40*a*.

Arranging the first vehicle side plate 36*a* on the floor surface 18 makes it possible to improve flexibility of a layout of the first rotating shaft 40*a* on the floor surface 18. In other words, the first rotating shaft 40*a* is not limited to the position of the vehicle body rear opening 12 (rearmost portion of the floor surface 18) and may be arranged, for example, at a position on the floor surface 18 located on the vehicle front side of the vehicle body rear opening 12. Note that other operation and advantageous effects of the other embodiment are the same as those in the embodiment described above and thus detailed description thereof will be omitted.

Subsequently, a mounting device 10*b* according to still another embodiment of the present invention will be described below.

Figure 12:
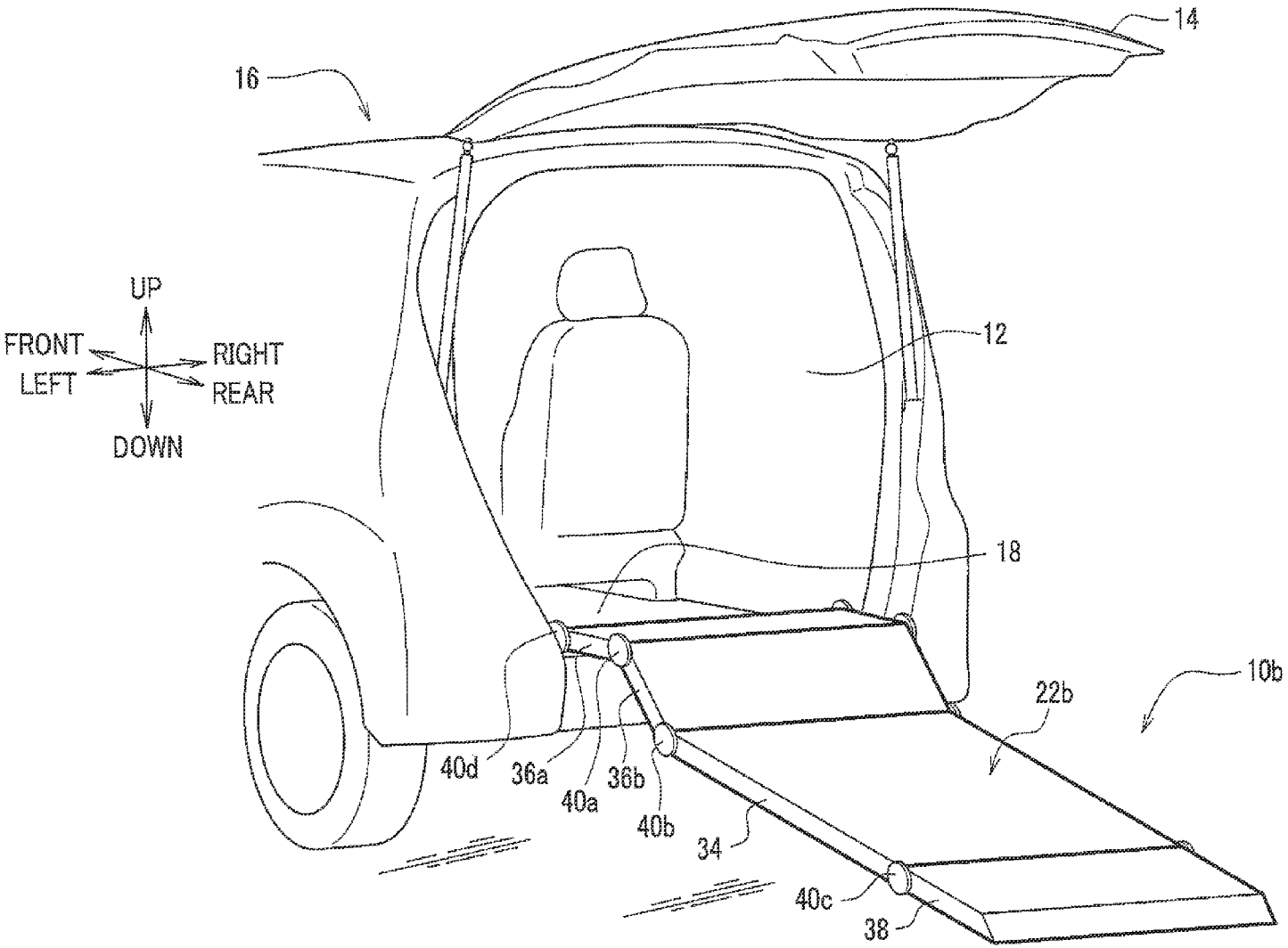
FIG. 12 is a perspective view of a vehicle and a slope to which a mounting device according to still another embodiment of the present invention is applied.
Figure 13:
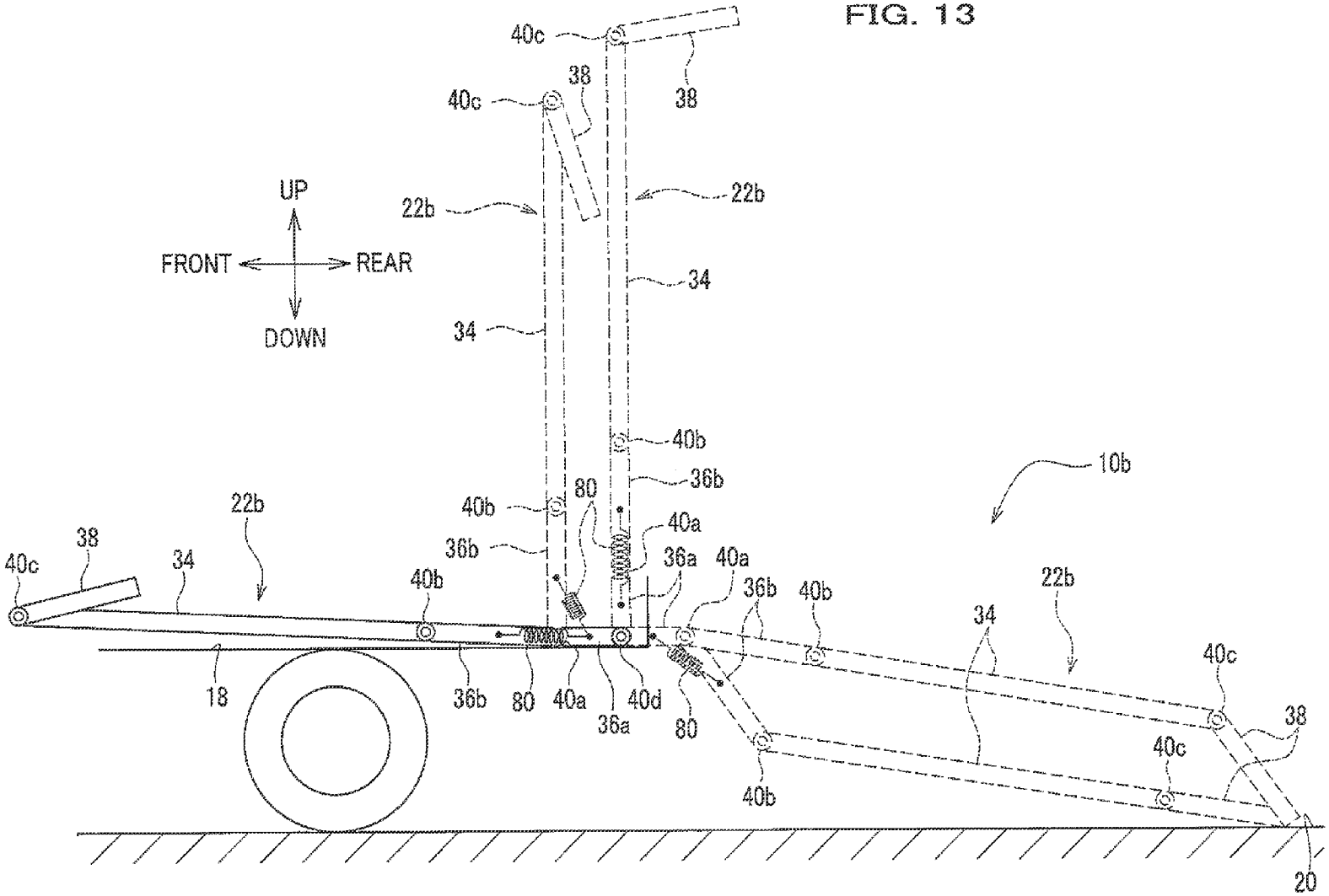
FIG. 13 is a side view showing a housed state, a first upright stationary state, a second upright stationary state, and a grounded state of the slope shown in FIG. 12.

FIG. 12 is a perspective view of a vehicle and a slope to which a mounting device according to still another embodiment of the present invention is applied; FIG. 13 is a side view showing a housed state, a first upright stationary state, a second upright stationary state, and a grounded state of the slope shown in FIG. 12; and FIG. 14 is a schematic diagram showing the housed state, the first upright stationary state, the second upright stationary state, and the grounded state of the slope shown in FIG. 12.

Figure 14:
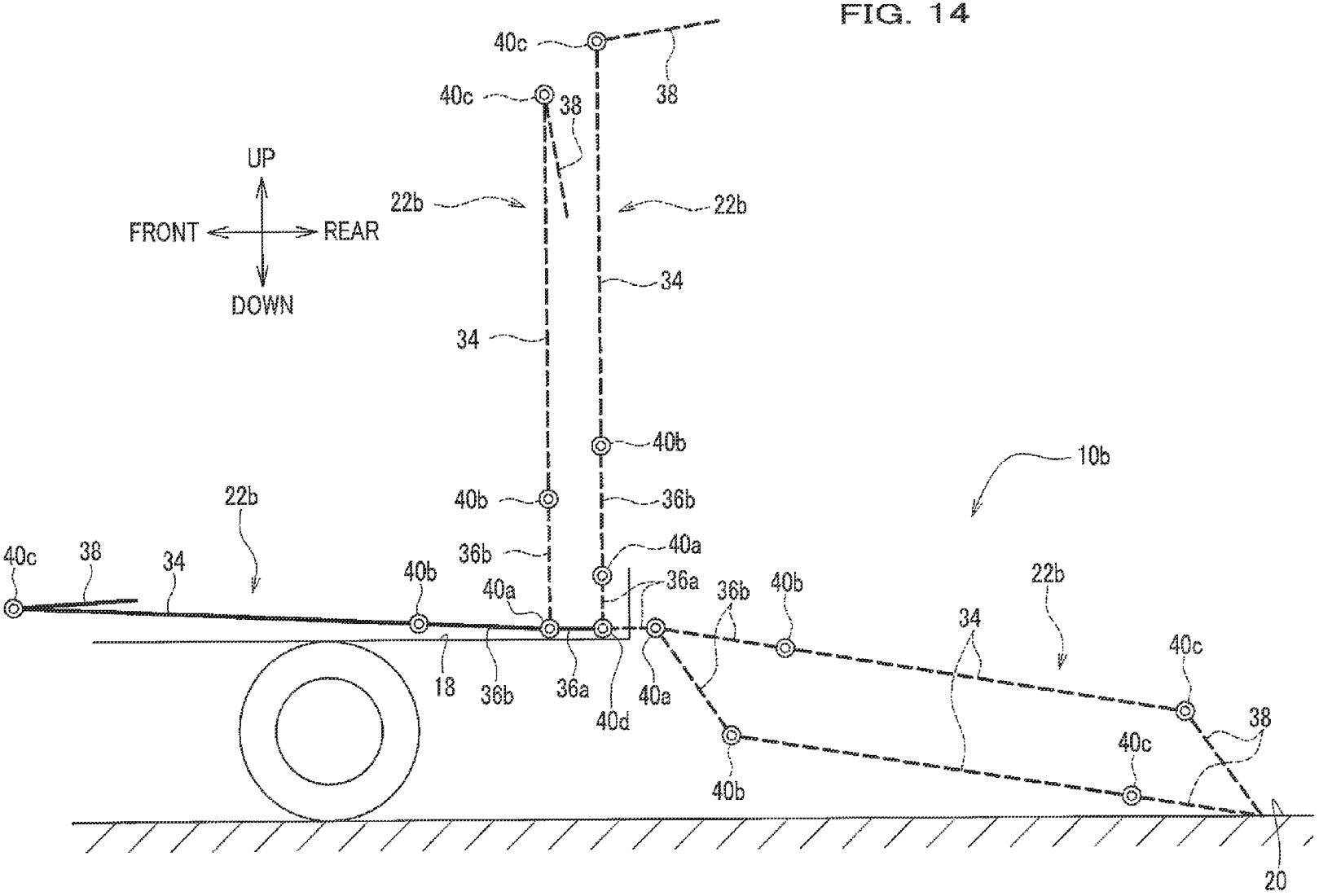
FIG. 14 is a schematic diagram showing the housed state, the first upright stationary state, the second upright stationary state, and the grounded state of the slope shown in FIG. 12.

Although the mounting device 10*b* according to the still another embodiment shown in FIG. 12 to FIG. 14 is common to the mounting device 10*a* in that the vehicle side plate is composed of two plates of the first vehicle sideplate 36*a* and the second vehicle side plate 36*b*, but is different from the mounting devices 10 and 10*a* in the embodiments described above in that a fourth rotating shaft (main rotating shaft) 40*d* which rotates a slope 22*b* in its entirety relative to the vehicle body is arranged at the front end portion of the first vehicle sideplate 36*a* in the vehicle front-rear direction. Note that the first rotating shaft 40*a* arranged between the first vehicle side plate 36*a* and the second vehicle side plate 36*b* functions as a sub rotating shaft.

Also, the mounting device 10*b* is different from the mounting devices 10 and 10*a* in that a spring member (rotating force urging means) 80 is provided between the rear end of the first vehicle side plate 36*a* and the front end of the second vehicle side plate 36*b*, which assists rotating movement of the second vehicle side plate 36*b* relative to the first vehicle side plate 36*a* with the first rotating shaft (sub rotating shaft) 40*a* as a fulcrum of rotation. Note that illustration of the spring member 80 is omitted in FIG. 12 and FIG. 14.

The fourth rotating shaft 40*d* functioning as the main rotating shaft is arranged between the vehicle body and the first vehicle side plate 36*a* to extend in the vehicle width direction at the front end portion of the first vehicle side plate 36*a* in the vehicle front-rear direction. The fourth rotating shaft 40*d* is rotatably supported on both sides in the vehicle width direction through a pair of bearing members (not shown) fixed to the vehicle body. Moreover, the fourth rotating shaft 40*d* is arranged on the floor surface 18 of the vehicle body rear opening 12, at a position displaced by a predetermined distance in the vehicle front direction from the rear end portion of the vehicle body.

The first rotating shaft 40*a* which is arranged between the first vehicle side plate 36*a* and the second vehicle side plate 36*b* and functions as the sub rotating shaft is arranged at a position displaced in the vehicle rear direction nearly along the horizontal direction from the floor surface 18 of the vehicle body rear opening 12. In other words, the fourth rotating shaft 40*d* is arranged on the floor surface 18 of the vehicle body in order to rotate the entire slope 22*b*, while the first rotating shaft 40*a* is arranged at a position away from the rear portion of the vehicle body by a predetermined distance in the vehicle rear direction in the outside of the vehicle.

The spring member 80 is composed of a coil spring which exerts tensile force, and is arranged on both sides (at least one side) in the vehicle width direction of the first vehicle side plate 36*a* and the second vehicle side plate 36*b*. As shown in FIG. 13, in the grounded state of the slope 22*b*, one end portion of the spring member 80 is fastened to the vehicle rear side of the first vehicle side plate 36*a*, and another end portion of the spring member 80 is fastened to the vehicle front side of the second vehicle side plate 36*b*. Tensile force of the spring member 80 acts on the first vehicle side plate 36*a* and the second vehicle side plate 36*b* to cause them to be pulled toward the side of the first rotating shaft 40*a*, which makes it possible to easily fold back the first vehicle side plate 36*a* and the second vehicle side plate 36*b*.

More specifically, as shown in FIG. 13 and FIG. 14, the first upright stationary state in which the first vehicle side plate 36*a* and the second vehicle side plate 36*b* both extend linearly along the vertical up-down direction, can be shifted to the second upright stationary state in which the first vehicle sideplate 36*a* is located on the floor surface 18, by flexing the first vehicle side plate 36*a* and the second vehicle side plate 36*b* to a state in which they are nearly perpendicular to each other with the first rotating shaft 40*a* as the fulcrum of rotation, through the tensile force of the spring member 80. In the second upright stationary state, the length of the slope 22*b* in the vertical up-down direction starting from the floor surface 18 becomes shorter by the length of the first vehicle side plate 36*a* which has been folded back. That is to say, the first upright stationary state can be easily shifted to the second upright stationary state by assisting, through the tensile force of the spring member 80, the rotating movement (folding movement) of the second vehicle side plate 36*b* relative to the first vehicle side plate 36*a* with the first rotating shaft (sub rotating shaft) 40*a* as the fulcrum of rotation.

In the present embodiment, the main plate 34 can be moved up and down by means of the first rotating shaft 40*a* and the entire slope 22*b* can be rotated by means of the fourth rotating shaft 40*d*. This makes it possible to separately arrange the fourth rotating shaft 40*d* for housing and expanding the slope 22*b* and the first rotating shaft 40*a* for moving up and down the main plate 34, respectively, and to arrange the first rotating shaft 40*a* at a position away from the rear portion of the vehicle body in the outside of the vehicle. Consequently, in the present embodiment, the rear portion of the vehicle body and the second vehicle side plate 36*b* can be suitably avoided from interfering with each other, for example, when the main plate 34 is moved down. That is to say, interference of the second vehicle side plate 36*b* with the rear portion of the vehicle body can be avoided by arranging the fourth rotating shaft 40*d* fixedly inside the vehicle body and arranging the first rotating shaft 40*a* outside the vehicle distanced from the fourth rotating shaft 40*d* and displaced (distanced) from the vehicle body.

Further, in the present embodiment, where the slope 22*b* is housed inside the vehicle body, when the first upright stationary state in which the first vehicle sideplate 36*a* and the second vehicle side plate 36*b* extend linearly, is shifted to the second upright stationary state in which the first vehicle side plate 36*a* and the second vehicle side plate 36*b* are nearly perpendicular to each other, the first upright stationary state can be smoothly shifted to the second upright stationary state by assisting, through the spring force of the spring member 80, the rotating movement of the second vehicle side plate 36*b* relative to the first vehicle side plate 36*a*.

Moreover, in the present embodiment, the vehicle body need not be provided as a dedicated vehicle body in which the slope 22*b* is installed, and thus it is possible to commoditize specs on a vehicle body in which the slope 22*b* is installed, and specs on a vehicle body in which the slope 22*b* is not installed, thereby improving versatility of vehicle bodies.

Note that, interference of the second vehicle side plate 36*b* with the rear portion of the vehicle body can be avoided, for example, by reducing the cross-section of a rear cross member constituting the rear portion of the vehicle body, but such configuration may reduce stiffness of the vehicle body. According to the present embodiment, however, a reduction in stiffness of the vehicle body can be suitably avoided.

Next, a mounting device 10*c* according to still another embodiment of the present invention will be described below.

Figures 15A, 15B:
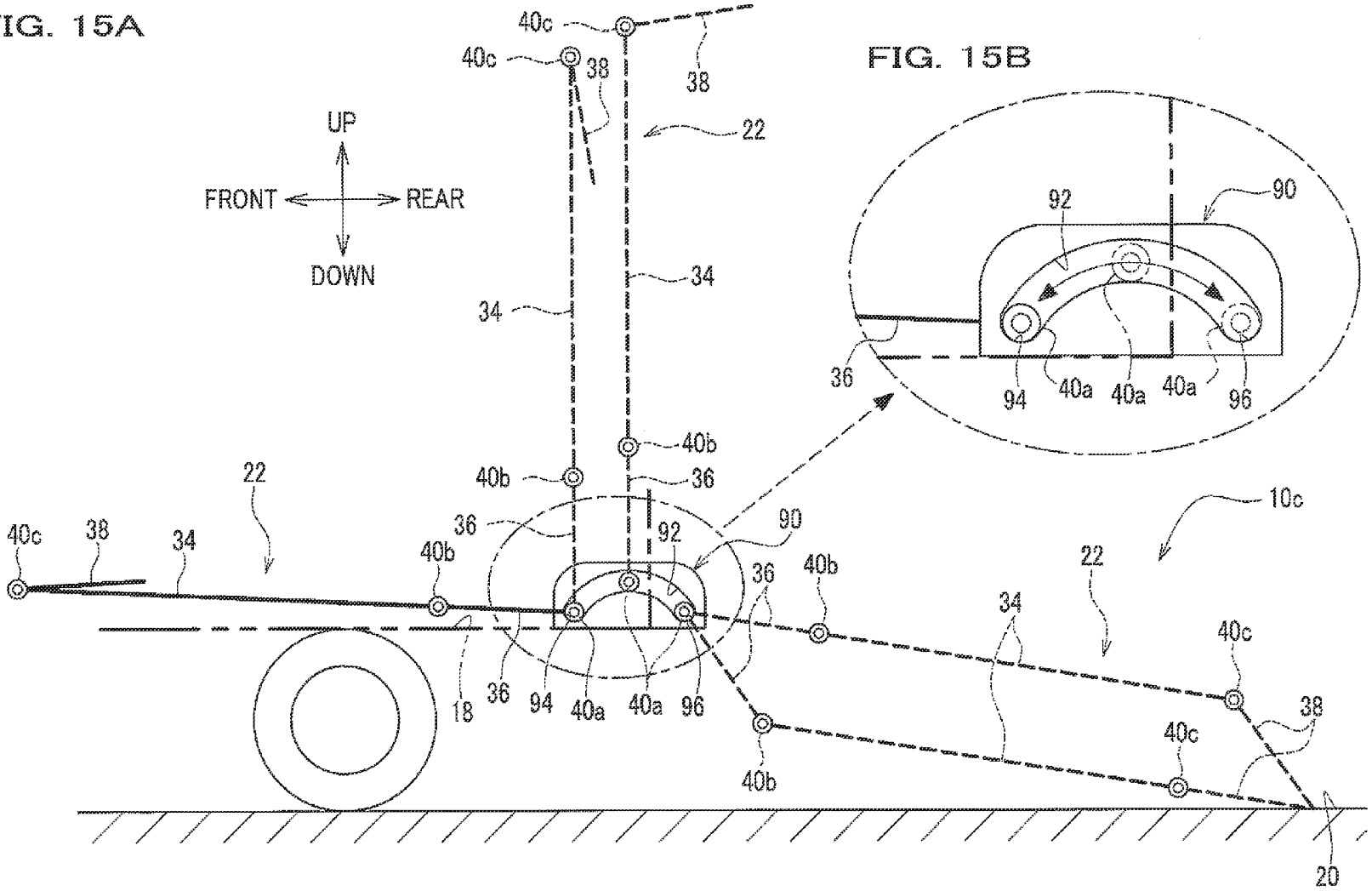
FIG. 15A is a schematic diagram of a vehicle and a slope to which a mounting device according to still another embodiment of the present invention is applied.
FIG. 15B is an enlarged partial view of a slit shown in FIG. 15A.
Figures 16A, 16B:
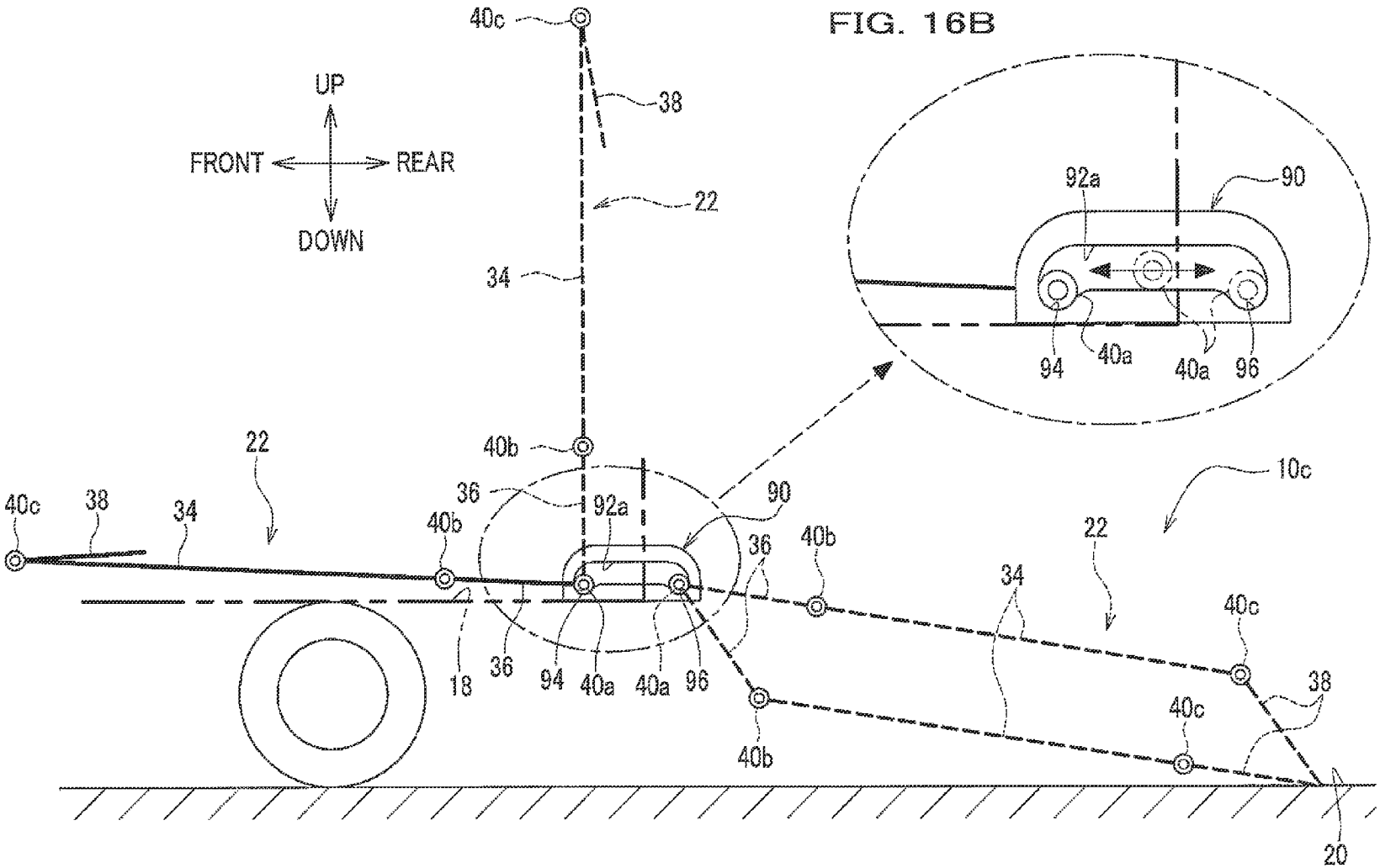
FIG. 16A is a schematic diagram of a vehicle and a slope to which a mounting device according to still another embodiment of the present invention is applied.
FIG. 16B is an enlarged partial view of a slit shown in FIG. 16A.

FIG. 15A is a schematic diagram of a vehicle and a slope to which a mounting device according to still another embodiment of the present invention is applied, and FIG. 15B is an enlarged partial view of a slit shown in FIG. 15A. FIG. 16A is a schematic diagram of a vehicle and a slope to which a mounting device according to still another embodiment of the present invention is applied, and FIG. 16B is an enlarged partial view of a slit shown in FIG. 16A.

As shown in FIG. 15A and FIG. 15B, the mounting device 10*c* according to the still another embodiment is different from the mounting devices 10, 10*a* and 10*b* in the embodiments described above in that a bracket 90 is provided at the rear portion of the vehicle body (e.g., a rear cross member), which displaces the first rotating shaft 40*a* functioning as the main rotating shaft in directions coming close to and getting away from the vehicle body. Note that a portion of the bracket 90 is provided projecting from the rear portion of the vehicle body (e.g., a rear cross member) to the rear side.

As shown in FIG. 15A, the bracket 90 is provided with a nearly U-shaped slit (holding portion) 92 which movably holds the first rotating shaft 40*a* along the vehicle front-rear direction in the directions coming close to and getting away from the rear portion of the vehicle body. As shown in FIG. 15B, formed at the front end along the vehicle front-rear direction of the slit 92 is a first concave portion (locking portion) 94 which locks the first rotating shaft 40*a* at a position inside the vehicle close to the rear portion of the vehicle body. On the other hand, formed at the rear end along the vehicle front-rear direction of the slit 92 is a second concave portion (locking portion) 96 which locks the first rotating shaft 40*a* at a position outside the vehicle away from the rear portion of the vehicle body. That is to say, when viewed from the first concave portion 94, the second concave portion 96 is located on the side of the vehicle body rear opening 12. In this case, "the side of the vehicle body rear opening 12" may be inside the vehicle in the front of the vehicle body rear opening 12, or may be outside the vehicle in the rear of the vehicle body rear opening 12. The first concave portion 94 and the second concave portion 96 are each formed so that the inner surface viewed from the side is in the form of an arc, and the first rotating shaft 40*a* is housed in the first concave portion 94 of arc-like shape or the second concave portion 96 of arc-like shape to be brought into a locked state in which the first rotating shaft 40*a* is locked at a predetermined position inside the vehicle or outside the vehicle.

In the present embodiment, the slope 22 can be moved to a position at which it can be housed in the vehicle body, by displacing the first rotating shaft 40*a* in the direction coming close to the vehicle body, through the slit 92 of the bracket 90. Moreover, when the main plate 34 is moved up and down, it can be displaced to a position outside the vehicle at which interference of the vehicle side plate 36 with the rear portion of the vehicle body can be avoided, by displacing the first rotating shaft 40*a* in the direction getting away from the vehicle body, through the slit 92 of the bracket 90.

Further, in the present embodiment, at the time of housing the slope 22, the first rotating shaft 40*a* can be locked at the position close to the vehicle body by holding the first rotating shaft 40*a* functioning as the main rotating shaft in the first concave portion 94, and at the time of moving up and down the main plate 34, the first rotating shaft 40*a* can be locked at the position away from the vehicle body by holding the first rotating shaft 40*a* in the second concave portion 96.

Moreover, although in the present embodiment, the slit 92 is formed in a nearly U-shape, for example, as shown in FIG. 16A and FIG. 16B, a slit 92*a* extending linearly along the vehicle front-rear direction may be provided to have a first concave portion 94 formed on the vehicle front side of the slit 92*a* and a second concave portion 96 formed on the vehicle rear side of the slit 92*a*.

Note that, although in the present embodiment, the first rotating shaft 40*a* is held in the first concave portion 94 and the second concave portion 96 of the slit 92 formed in the bracket 90, the first rotating shaft 40*a* may be locked in the directions coming close to and getting away from the vehicle body, for example, using a locking mechanism such as a locking pin (not shown).

REFERENCE SIGNS LIST

10, 10*a*, 10*b*, 10*c*: Mounting device (Mounting device for object to be mounted)
16: Vehicle
20: Ground surface
22: Slope
26: Wheelchair (Object to be mounted)
34: Main plate
36: Vehicle side plate
36*a*: First vehicle side plate
36*b*: Second vehicle side plate
38: Ground side plate
40*a* to 40*d*: First to fourth rotating shafts
40*a*: First rotating shaft (Sub rotating shaft, Main rotating shaft)
40*d*: Fourth rotating shaft (Main rotating shaft)
42: Drive mechanism (Drive means)
46: Grip portion
80: Spring member (Rotating force urging means)
90: Bracket (Shaft displacing means)
92, 92*a*: Slit (Holding portion)
94, 96: Concave portion (Locking portion)
S: Virtual straight line

The invention claimed is:

1. A mounting device for an object to be mounted, comprising:
- a main plate on which the object to be mounted is to be mounted;
- a vehicle side plate which is provided between one end of the main plate and a vehicle body, and includes a first vehicle side plate and a second vehicle side plate;
- a ground side plate which is provided between another end of the main plate and a ground surface, and is composed of at least one plate;
- a plurality of rotating shafts which are provided between the vehicle body and the vehicle side plate, and between each of the plates, the plurality of rotating shafts including: a sub rotating shaft which is arranged between and connects the first vehicle side plate and the second vehicle side plate, and a main rotating shaft which is arranged between the vehicle body and the first vehicle side plate, wherein the first vehicle side plate is rotatably provided on the vehicle body with the main rotating shaft as a fulcrum of rotation; and
- a drive means that rotates the rotating shafts, wherein
- a slope is configured to include the main plate, the vehicle side plate, the ground side plate, and the plurality of rotating shafts, and
- the slope is provided to allow the main plate to be displaced between a low position and a high position by rotating the plurality of rotating shafts with the drive means with the ground side plate resting on the ground surface.

2. A mounting device for an object to be mounted, comprising:
- a main plate on which the object to be mounted is to be mounted;
  - a vehicle side plate which is provided between one end of the main plate and a vehicle body, and is composed of at least one plate;
  - a ground side plate which is provided between another end of the main plate and a ground surface, and is composed of at least one plate;
  - a plurality of rotating shafts which are provided between the vehicle body and the vehicle side plate, and between each of the plates; and
  - a drive means that rotates the rotating shafts, wherein
  - a slope is configured to include the main plate, the vehicle side plate, the ground side plate, and the plurality of rotating shafts,
  - the slope is provided to allow the main plate to be displaced between a low position and a high position by rotating the plurality of rotating shafts with the drive means with the ground side plate resting on the ground surface, and
  - a size of the vehicle side plate in a direction perpendicular to the rotating shafts is set to be equal to a size of the ground side plate in the direction perpendicular to the rotating shafts.

3. The mounting device for the object to be mounted, according to claim 1, wherein
- a size of the main plate in a direction perpendicular to the rotating shafts is set to be larger than a size of the vehicle side plate in the direction perpendicular to the rotating shafts and a size of the ground side plate in the direction perpendicular to the rotating shafts.

4. The mounting device for the object to be mounted, according to claim 1, wherein a total of a size of the vehicle side plate in a direction perpendicular to the rotating shafts, a size of the main plate in the direction perpendicular to the rotating shafts, and a size of the ground side plate in the direction perpendicular to the rotating shafts, is set to be larger than a size of a virtual straight line which connects the ground surface with a shaft center of the rotating shaft provided between the one end of the main plate and the vehicle body.

5. The mounting device for the object to be mounted, according to claim 1, wherein when the main plate is in a state of the low position, an axial line in a vehicle front-rear direction of the main plate and an axial line in the vehicle front-rear direction of the ground side plate are set to be flush with and parallel to each other.

6. The mounting device for the object to be mounted, according to claim 1, wherein when the main plate is in a state of the high position, an axial line in a vehicle front-rear direction of the second vehicle side plate and an axial line in the vehicle front-rear direction of the main plate are set to be flush with and parallel to each other.

7. The mounting device for the object to be mounted, according to claim 1, further comprising a grip portion which is provided on an upper surface of the ground side plate and is to be gripped by an operator.

8. The mounting device for the object to be mounted, according to claim 1, further comprising a rotating force urging means that is provided on the first vehicle side plate and the second vehicle side plate and assists rotating movement of the second vehicle side plate relative to the first vehicle side plate with the sub rotating shaft as a fulcrum of rotation.

9. The mounting device for the object to be mounted, according to claim 1, wherein the plurality of rotating shafts further includes a main rotating shaft which rotates the entire slope, and further comprising a shaft displacing means that is provided at a rear portion of the vehicle body and displaces the main rotating shaft in directions coming close to and getting away from the vehicle body.

10. The mounting device for the object to be mounted, according to claim 9, wherein the shaft displacing means is a bracket which is fixed to the vehicle body, and the bracket includes a holding portion which displaceably holds the main rotating shaft in the directions coming close to and getting away from the vehicle body, and a locking portion which locks the main rotating shaft in the directions coming close to and getting away from the vehicle body.

11. The mounting device for the object to be mounted, according to claim 1, wherein the slope is provided to allow the main plate to be displaced between the low position and the high position while maintaining an angle of the main plate relative to the ground surface by rotating the plurality of rotating shafts with the drive means.

12. The mounting device for the object to be mounted, according to claim 1, wherein the plurality of rotating shafts are provided between and connect the main plate and the second vehicle side plate, and the main plate and the ground side plate.

13. The mounting device for the object to be mounted, according to claim 1, wherein the drive means rotates the plurality of rotating shafts so that the distal end of the ground side plate rests on the ground surface while the main plate is in the low position, while the main plate is displaced between the low position and the high position, and while the main plate is in the high position.

14. The mounting device for the object to be mounted, according to claim 2, wherein a size of the main plate in a direction perpendicular to the rotating shafts is set to be larger than a size of the vehicle side plate in the direction perpendicular to the rotating shafts and a size of the ground side plate in the direction perpendicular to the rotating shafts.

* * * * *